US011081249B2

(12) United States Patent
Singh et al.

(10) Patent No.: US 11,081,249 B2
(45) Date of Patent: Aug. 3, 2021

(54) NUCLEAR WASTE CASK WITH IMPACT PROTECTION

(71) Applicant: HOLTEC INTERNATIONAL, Camden, NJ (US)

(72) Inventors: Krishna P. Singh, Jupiter, FL (US); Charles W. Bullard, II, Merion Station, PA (US); Xuejun Zhai, Mount Laurel, NJ (US)

(73) Assignee: HOLTEC INTERNATIONAL

( * ) Notice: Subject to any disclaimer, the term of this patent is extended or adjusted under 35 U.S.C. 154(b) by 0 days.

(21) Appl. No.: 17/061,700

(22) Filed: Oct. 2, 2020

(65) Prior Publication Data

US 2021/0118586 A1 Apr. 22, 2021

Related U.S. Application Data

(60) Provisional application No. 62/910,073, filed on Oct. 3, 2019.

(51) Int. Cl.

| | |
|---|---|
| ***G21F 5/08*** | (2006.01) |
| ***G21F 5/00*** | (2006.01) |
| ***G21F 5/008*** | (2006.01) |

(52) U.S. Cl.

CPC ..... *G21F 5/08* (2013.01); *G21F 5/008* (2013.01)

(58) Field of Classification Search

CPC ..... G21F 5/08; G21F 5/008

USPC ..... 250/505.1, 506.1, 507.1, 515.1, 516.1, 250/517.1, 518.1, 519.1

See application file for complete search history.

(56) References Cited

U.S. PATENT DOCUMENTS

| | | | | |
|---|---|---|---|---|
| 4,336,460 | A * | 6/1982 | Best | G21F 5/008 250/506.1 |
| 5,394,449 | A | 2/1995 | Johnson et al. | |
| 9,466,400 | B2 * | 10/2016 | Singh | G21F 5/08 |
| 10,410,756 | B2 | 9/2019 | Singh | |
| 2004/0071254 | A1 | 4/2004 | Malalel | |
| 2009/0114856 | A1 * | 5/2009 | Shimojo | G21F 5/08 250/506.1 |

(Continued)

FOREIGN PATENT DOCUMENTS

JP 2003315493 A 11/2003

OTHER PUBLICATIONS

International Search Report and Written Opinion issued for PCT/US2020/053916 dated Feb. 19, 2021, pp. 1-8.

*Primary Examiner* — Nicole M Ippolito

(74) *Attorney, Agent, or Firm* — The Belles Group, P.C.

(57) ABSTRACT

A nuclear waste cask with impact protection includes impact limiters detachably coupled to opposite ends of the cask. Each impact limiter may comprise a deformable energy-absorbing perforated sleeve of cylindrical shape comprising an array of closely-spaced longitudinally elongated perforations. The perforations may comprise longitudinal passages having a circular cross-sectional shape in certain embodiments. The perforated sleeve may have an annular metallic body of monolithic unitary structure in which the perforations are formed and a central opening to receive the ends of the cask therein. When exposed to external impact forces such as created by dropping the cask, the perforations collapse inwards in the impact or crush zone to absorb the energy of fall while preventing or minimizing any forces transmitted to the cask to maintain the integrity of waste containment barrier.

30 Claims, 29 Drawing Sheets

(56) References Cited

U.S. PATENT DOCUMENTS

| | | | | |
|---|---|---|---|---|
| 2010/0104061 | A1* | 4/2010 | Argoud | G21F 5/14 376/272 |
| 2013/0068578 | A1 | 3/2013 | Saito et al. | |
| 2014/0219408 | A1* | 8/2014 | Singh | G21F 5/008 376/272 |
| 2015/0092903 | A1 | 4/2015 | Tuite et al. | |

* cited by examiner

NUCLEAR WASTE CASK WITH IMPACT PROTECTION

CROSS-REFERENCE TO RELATED APPLICATIONS

This application claims the benefit of U.S. Provisional Application No. 62/910,073 filed Oct. 3, 2019, which is incorporated herein by reference in its entirety.

BACKGROUND

The present invention relates generally to systems and apparatuses for storing high level radioactive waste such as used or spent nuclear fuel, and more particularly to an improved nuclear fuel cask with impact protection.

In the operation of nuclear reactors, the nuclear energy source is in the form of hollow zircaloy tubes filled with enriched uranium, collectively arranged in multiple assemblages referred to as fuel assemblies. When the energy in the fuel assembly has been depleted to a certain predetermined level, the used or "spent" nuclear fuel (SNF) assemblies are removed from the nuclear reactor. The standard structure used to package used or spent fuel assemblies discharged from light water reactors for off-site shipment or on-site dry storage is known as the fuel basket. The fuel basket is essentially an assemblage of prismatic storage cells each of which is sized to store one fuel assembly that comprises a plurality of individual spent nuclear fuel rods. The fuel basket is arranged inside a cylindrical metallic storage canister (typically stainless steel), which is often referred to as a multi-purpose canister (MPC), which forms the primary nuclear waste containment barrier. The fuel assemblies are typically loaded into the canister while submerged in the spent fuel pool of the reactor containment structure to minimize radiation exposure to personnel. The canisters which typically comprise a single metal shell have limited ability however to block or attenuate the gamma and neutron radiation emitted by the decaying SNF other than borated water remaining in the canister from the spent fuel pool.

To transport the nuclear waste canister loaded with SNF or other waste, the canister is placed into a radiation-shielded outer ventilated overpack or cask for safe transport and storage of the waste. The cask forms the secondary containment barrier. Casks are used to transfer the SNF or other high level nuclear waste from the spent fuel pool (e.g. "transfer cask") in the nuclear reactor containment structure to a more remote interim term storage such as in the dry cask storage system of an on-site or off-site independent spent fuel storage installation (ISFSI) until a final repository for spent nuclear fuel is available from the federal government.

A typical modern transport cask, used to move radiative nuclear waste, including spent nuclear fuel, is a heavy cylindrical weldment transported over railroads or occasionally by sea on ships. A typical transport cask may be equipped with an impact limiter of some form at each extremity. The external diameter of such cask package is governed by the narrowest passage through which the rail car carrying the loaded cask must pass. Typically, the narrowest passageway in the cask package's travel path is a tunnel, or sometimes a low-profile bridge underpass. Since casks are extremely tall structures, the casks are typically transported in a horizontal position on the rail car. In the US, the outside diameter (OD) of the impact limiter is limited to 128 inches to avoid clearance issues in tunnels. In most other countries, it is even smaller.

Impact limiters are fabricated from energy-absorbing materials that prevent or limit structural damage to the transport cask in case of an accident to prevent release of radiation to the environment. Such devices are mandate by the NRC (Nuclear Regulatory Commission) for nuclear waste transport packages such as casks and must undergo drop tests to evaluate their effectiveness. In the past, plastic foams, metal honeycombs, and wood have been used. Impact limiters made of organic materials such as wood have many drawbacks. Wood is inherently non-homogeneous and non-isotropic, its strength properties are affected by weather, and it is flammable. Therefore, the main appeal of wood impact limiter is low cost. The standard honeycomb impact limiter is made by placing alternate layers of solid corrugated aluminum sheets or panels 10 laid out in alternating orthogonal directions to each other and bonding the layers together by a high-temperature epoxy (see, e.g. FIG. 29). The layers are cut to a circular or other shape and stacked on top of each other being oriented transversely to longitudinal axis of the cask such that there are no openings between the layers extend in the longitudinal direction of the cask. Honeycomb impact limiters are typically time intensive and expensive to manufacture, and in generally scare supply.

Accordingly, there remains a need for improvements in impact limiters for nuclear waste transport casks.

BRIEF SUMMARY

The present application discloses a nuclear waste transport cask with improved impact protection provided by impact limiters which are economical to manufacture and overcome the drawbacks of the foregoing prior impact limiter designs. The present impact limiters comprise cylindrical structures which are detachably coupled to the top and bottom extremities of the cask. Each impact limiter may comprise a deformable and crushable annular metallic perforated impact barrel or sleeve of cylindrical shape comprising a plurality of elongated perforations in the form of longitudinal passages. The passages may have a circular cross-sectional shape in certain embodiments. The perforated sleeve has an annular metallic body of monolithic unitary structure in which the perforations are formed and an enlarged central opening to receive the ends of the cask therein.

The longitudinal passages of the perforated sleeve form open passageways which extend between opposite ends of the sleeve in a direction parallel to each other, and in one embodiment parallel to the longitudinal axis of the vertically elongated transport cask. The passages define ligaments or webs of solid material between adjacent perforations. When the impact limiters are subjected to an inward-acting external impact force having a radial component (e.g. perpendicular or obliquely angled transversely to the longitudinal axis of the cask) caused by dropping the cask horizontally on its side or end first at an angled orientation to horizontal, the perforations radially collapse in the impact or crush zone. The outer webs in the impact zone increasingly deform inwardly under the impact while collapsing the perforations, and may contact at least some of the more inner webs in the crush zone which slows the progression of deformation and collapse of the impact ring is resisted by the solid web material. The amount of deformation experienced by perforation sleeve or ring is generally the result of the magnitude of the external impact force, diameter of perforations, pitch or spacing between the perforations, diameter of the perforations and web thickness, and modulus of elasticity of metal selected for the impact rings. In one example, the impact rings may be formed of a soft isotropic material such as without limitation a suitable grade or alloy of aluminum; however, other suitable metallic materials may be used.

According to one aspect, a nuclear waste cask with impact protection comprises: a longitudinal axis; a longitudinally elongated cask body including a top end, a bottom end, a sidewall extending between the ends, and a cavity configured for holding a nuclear waste canister; and an impact limiter coupled to the top end of the cask body, the impact limiter comprising an annular perforated sleeve having a body including a central opening and a circumferential array of elongated longitudinal passages formed therethrough around the central opening. The body of the perforated sleeve may be formed of a solid metal ring of monolithic unitary structure. The longitudinal passages may be oriented parallel to each other and the longitudinal axis of the cask in one embodiment.

According to another aspect, a nuclear waste cask with impact protection comprises: a longitudinal axis; a longitudinally elongated cask including a top end, a bottom end, a sidewall extending between the ends, and a cavity configured for holding a nuclear waste canister; and an impact limiter coupled to each of the top and bottom ends of the cask; the impact limiter comprising an outer shell and an inner perforated core of monolithic unitary structure. In one embodiment, the perforated core comprises an annular sleeve including a plurality of elongated longitudinal passages oriented parallel to the longitudinal axis of the cask.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein like elements are labeled similarly and in which.

Figure 1:
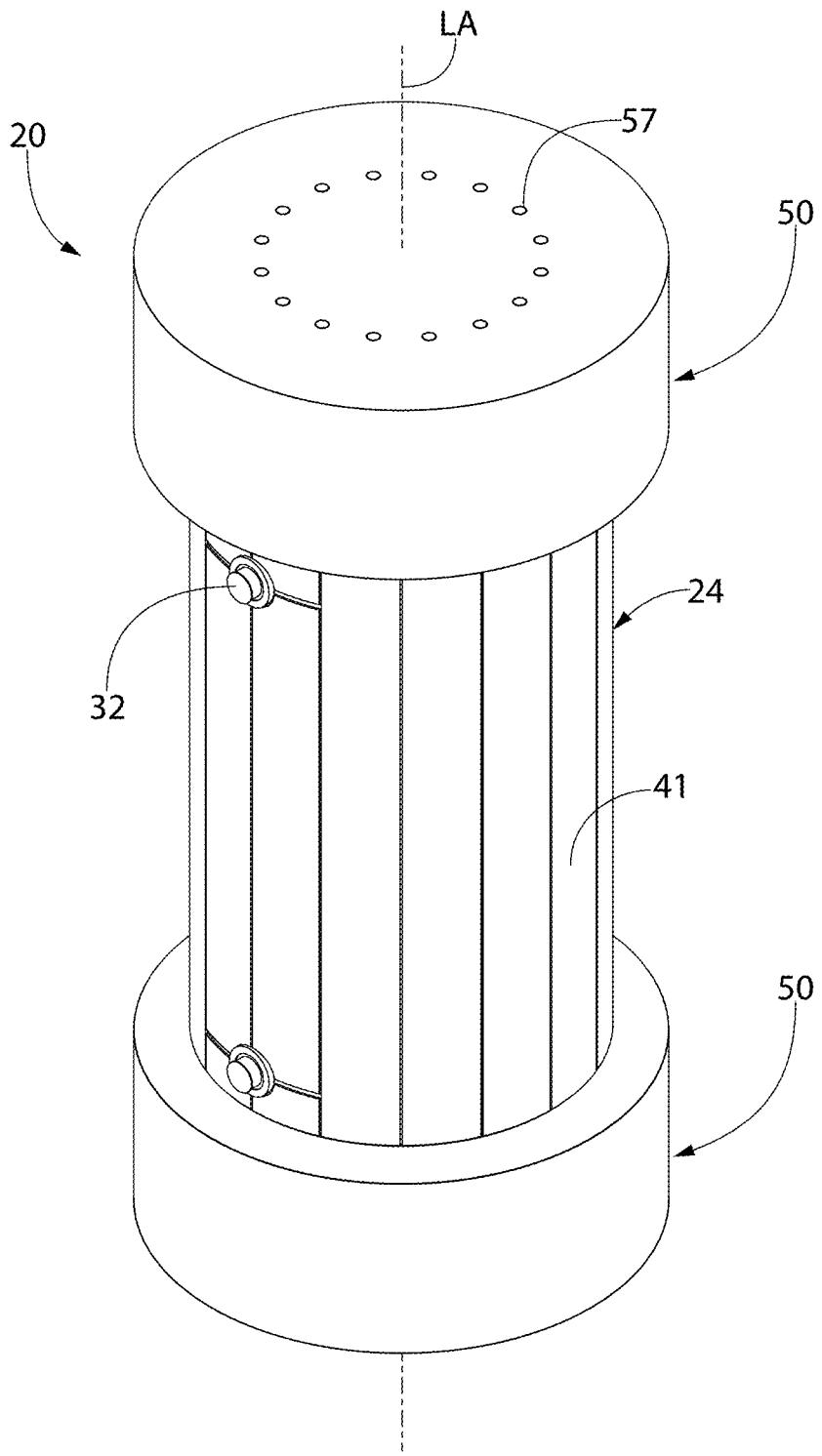
FIG. 1 is a top perspective view of a nuclear waste cask for storing high level radioactive materials with mounted impact limiters according to the present disclosure.
Figure 2:
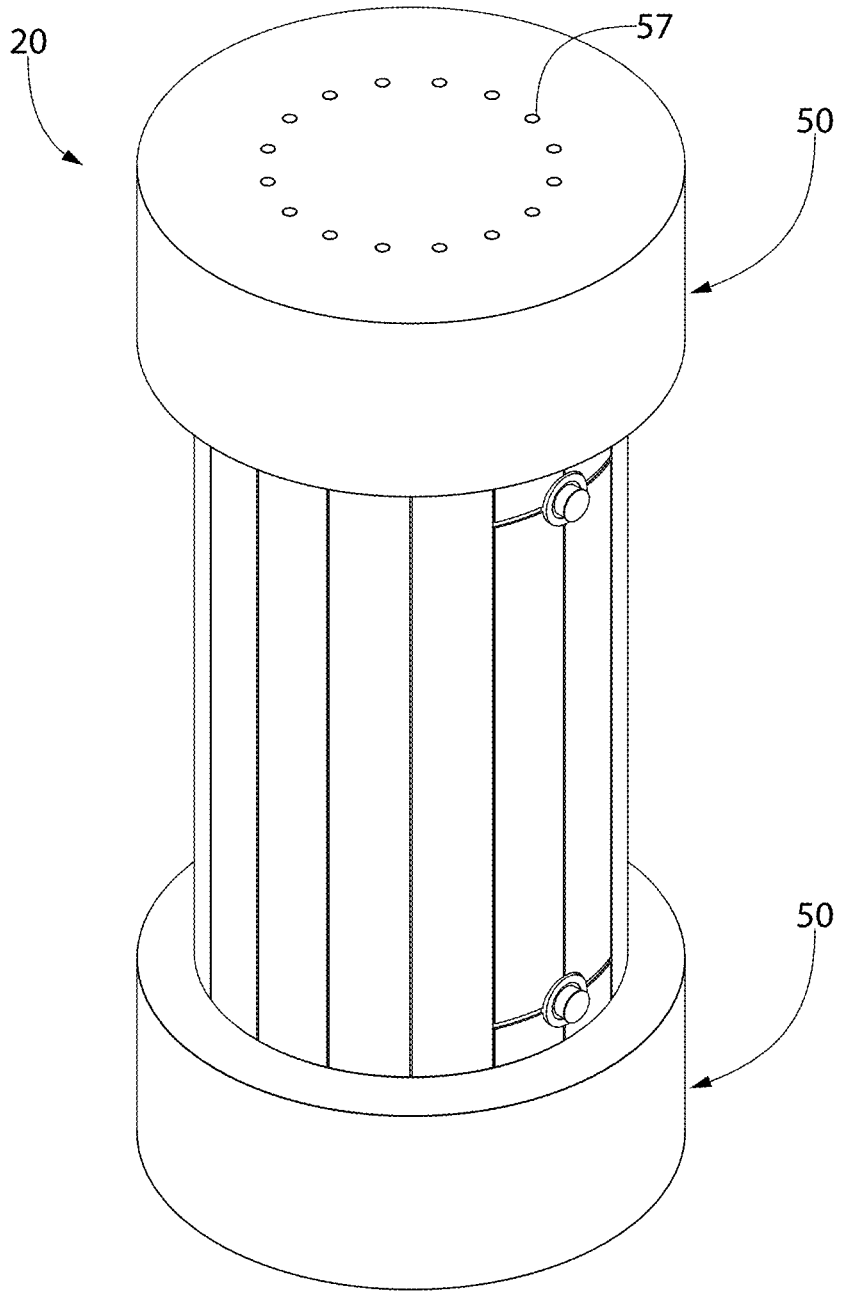
FIG. 2 is a second top perspective view thereof.
Figure 3:
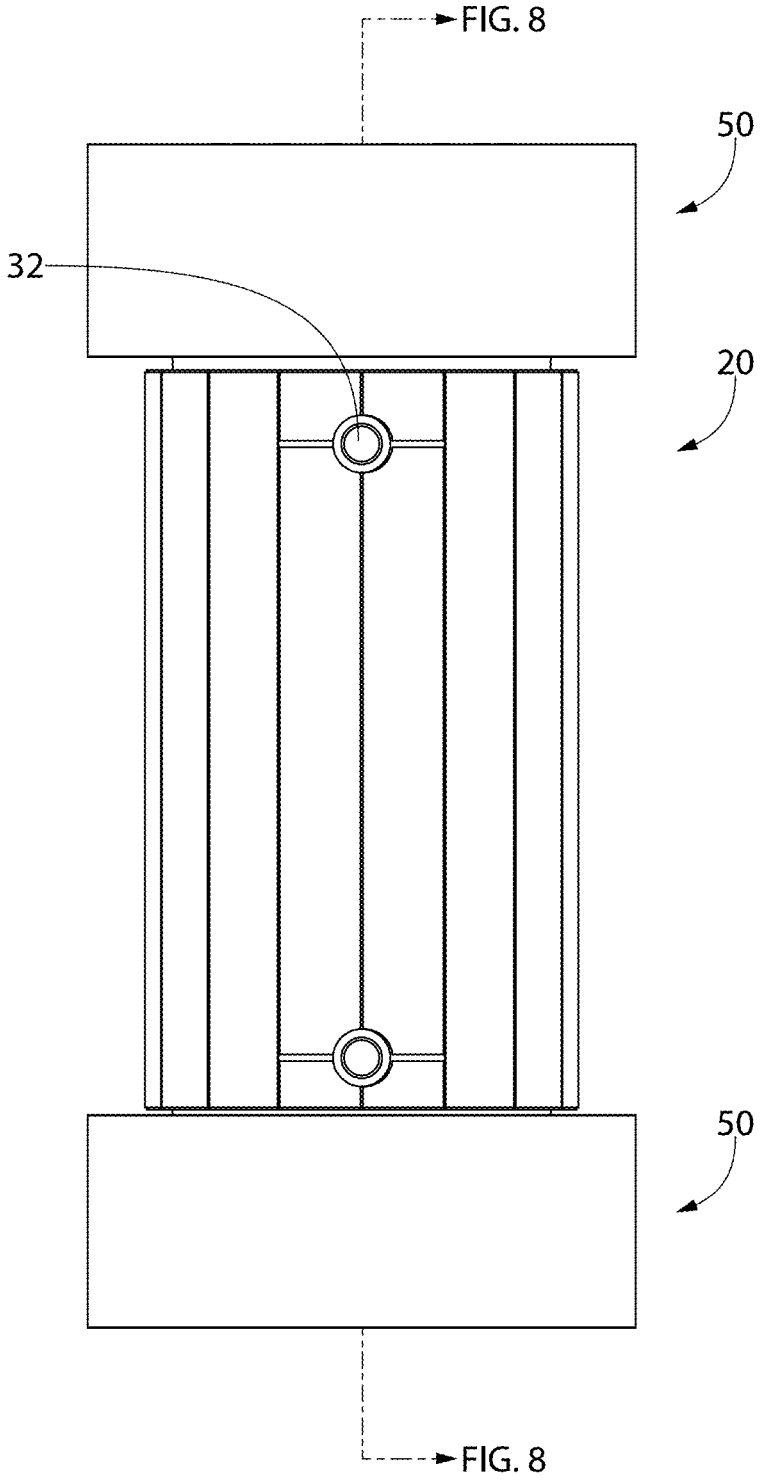
FIG. 3 is a first side view thereof.
Figure 4:
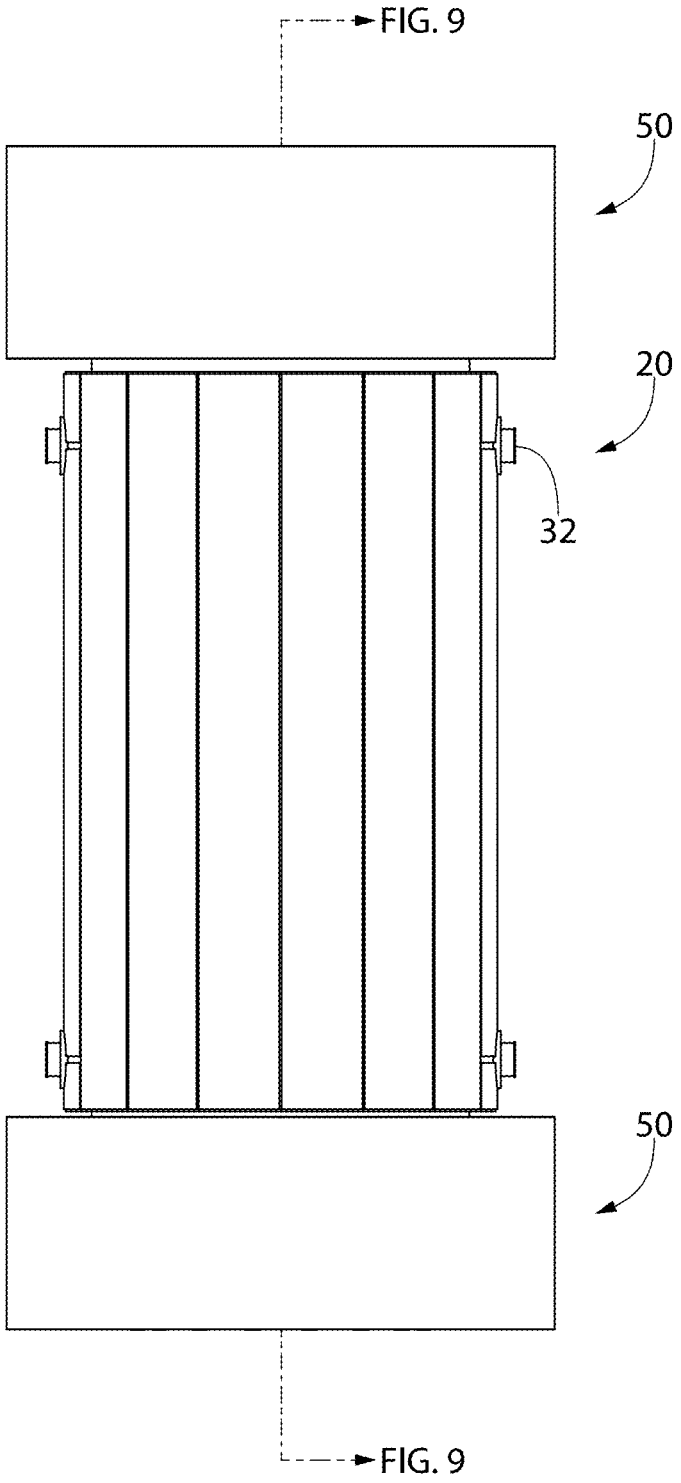
FIG. 4 is a second side view thereof.
Figure 5:
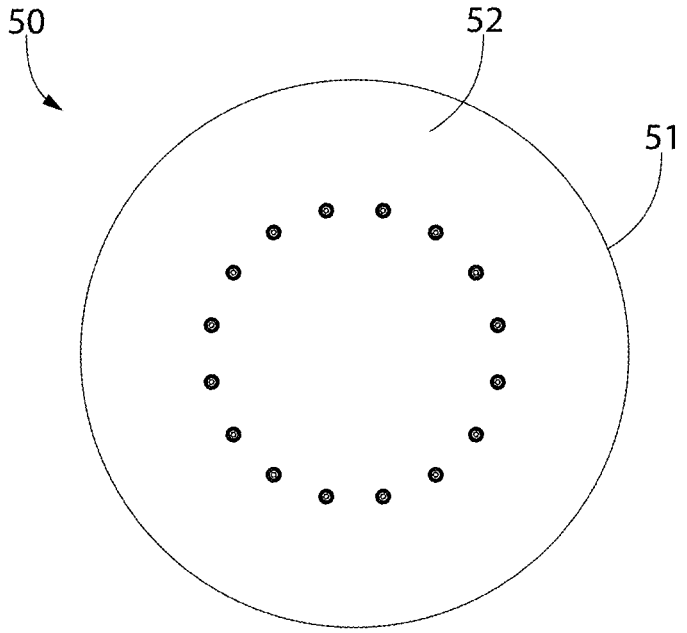
FIG. 5 is a top view thereof.
Figure 6:
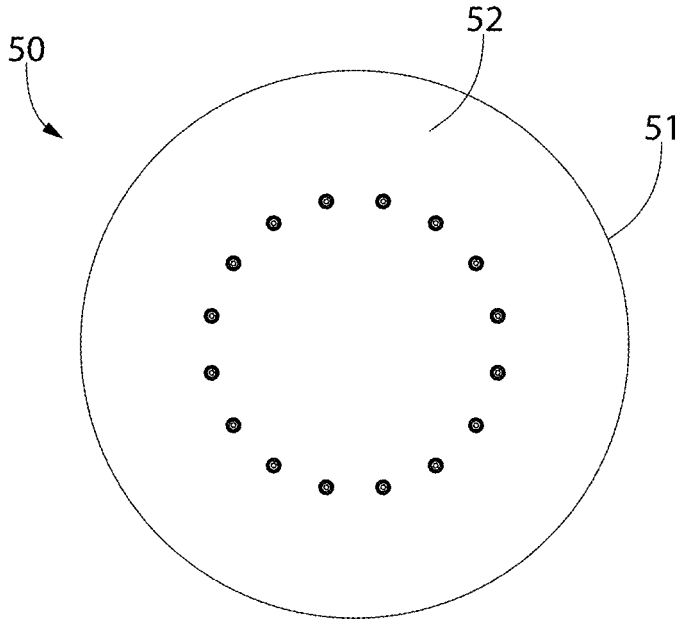
FIG. 6 is a bottom view thereof.
Figure 7:
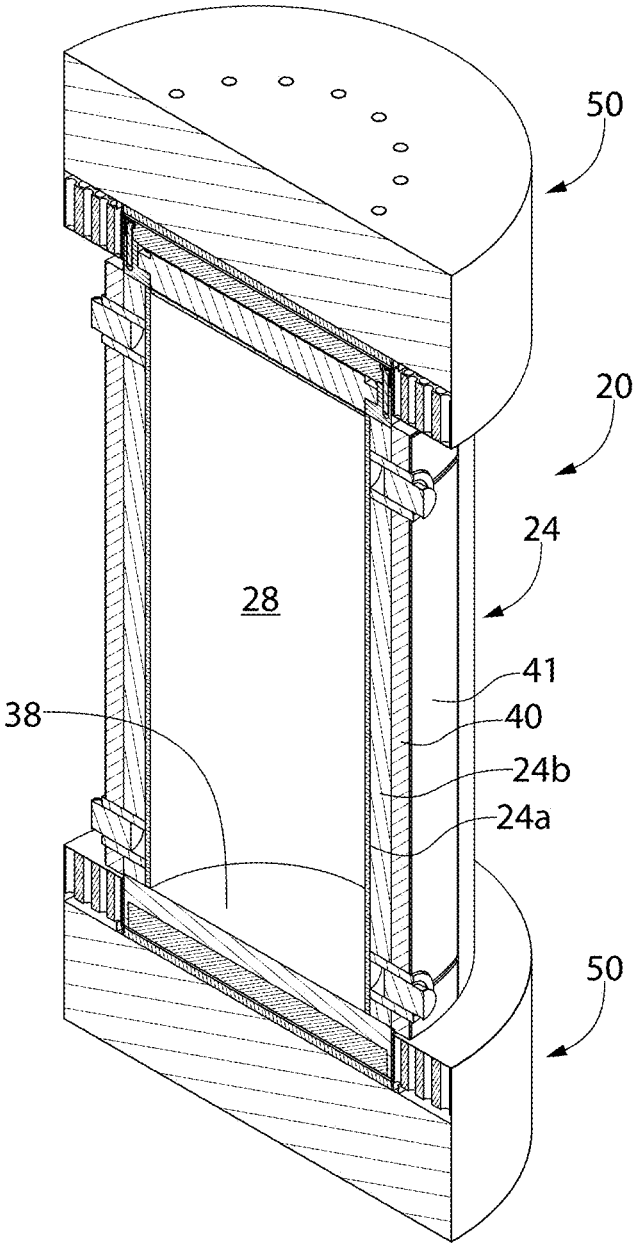
FIG. 7 is a longitudinal cross-sectional perspective view thereof.
Figure 8:
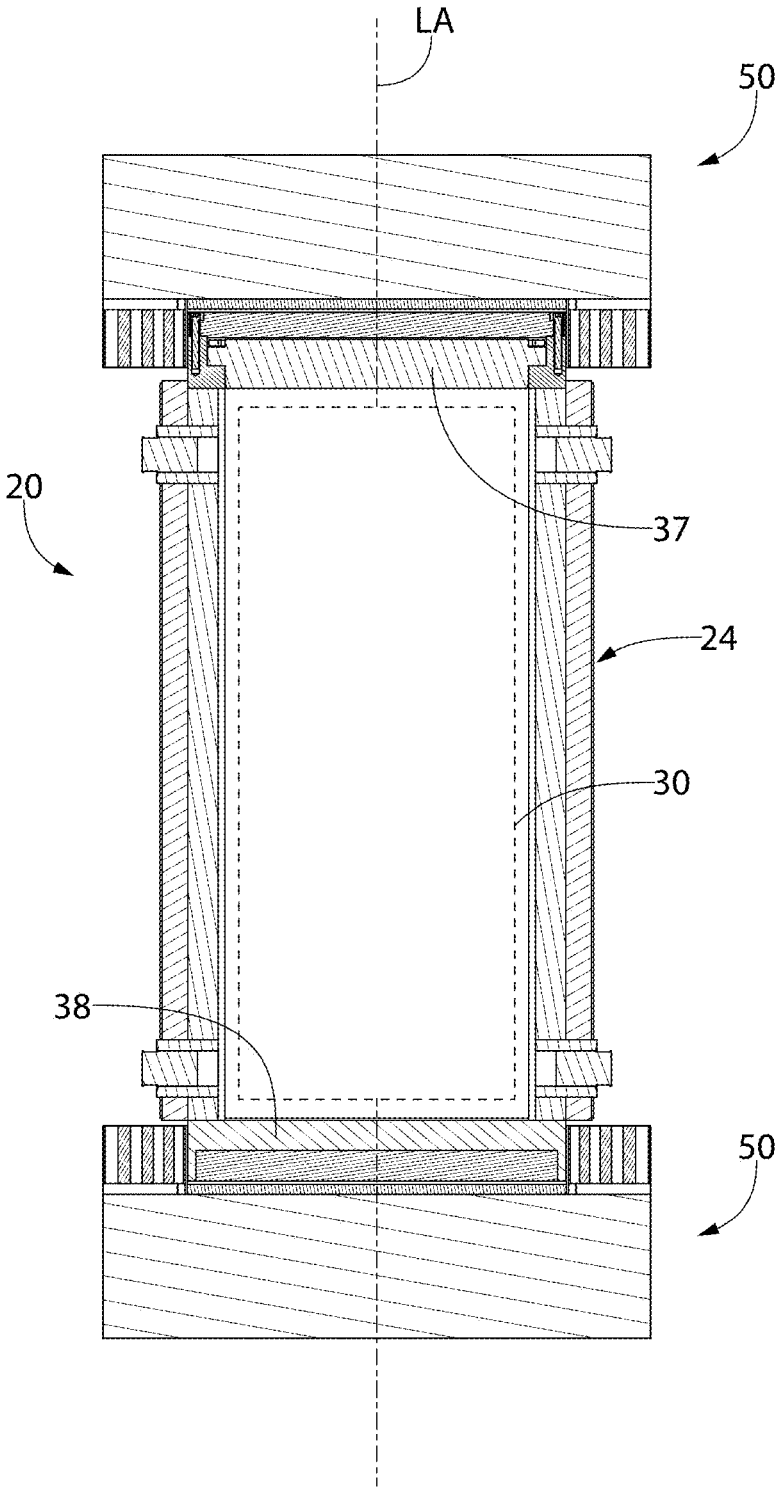
FIG. 8 is a first side cross-sectional view thereof.
Figure 9:
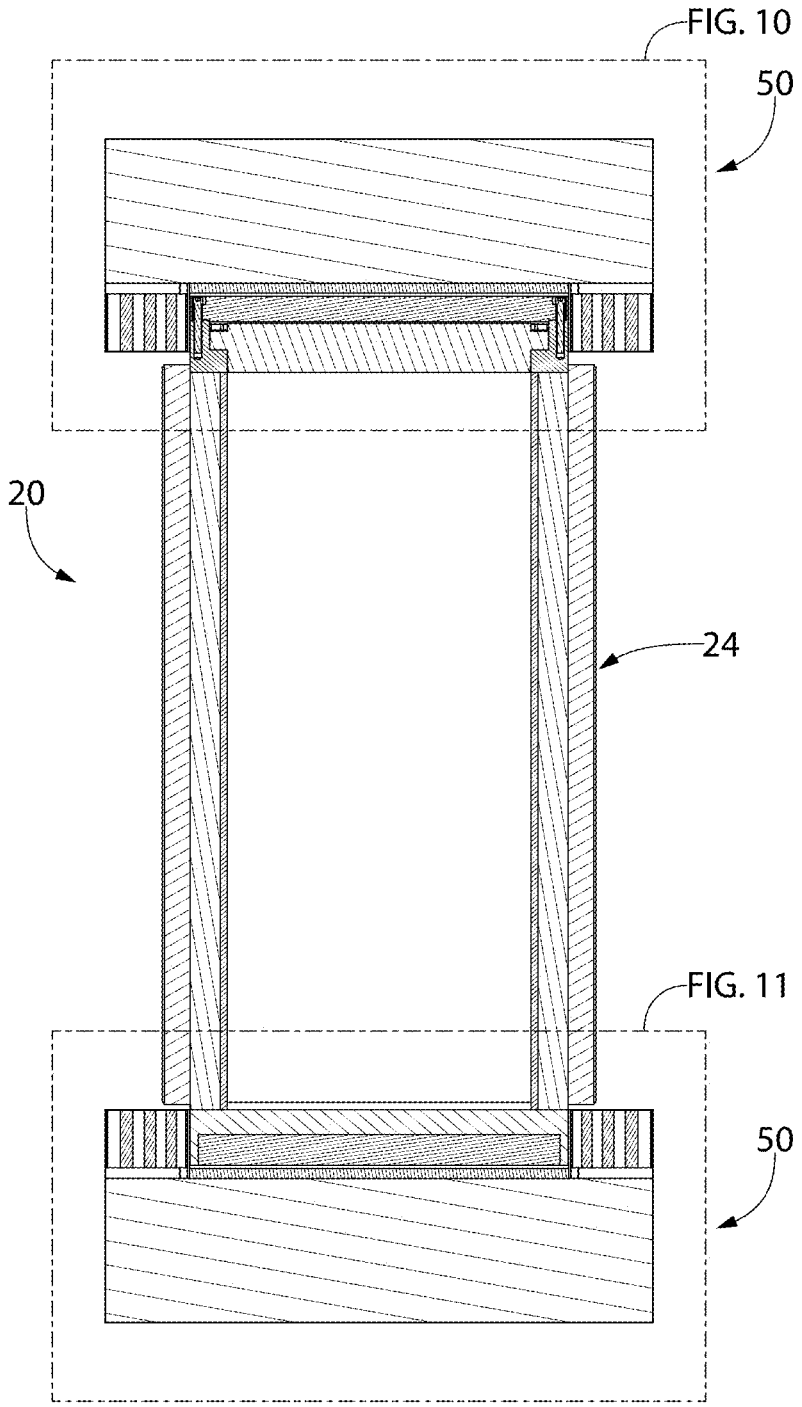
FIG. 9 is a second side cross-sectional view thereof.

All drawings are schematic and not necessarily to scale. Features shown numbered in certain figures which may appear un-numbered in other figures are the same features unless noted otherwise herein.

DETAILED DESCRIPTION

The features and benefits of the invention are illustrated and described herein by reference to non-limiting exemplary ("example") embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

As used throughout, any ranges disclosed herein are used as shorthand for describing each and every value that is within the range. Any value within the range can be selected as the terminus of the range. In addition, any references cited herein are hereby incorporated by reference in their entireties. In the event of a conflict in a definition in the present disclosure and that of a cited reference, the present disclosure controls.

As used herein, the terms "seal weld or welding" shall be construed according to its conventional meaning in the art to be a continuous weld which forms a gas-tight joint between the parts joined by the weld.

Because the extent of crush depth available in the radial direction of the cask is limited by the diameter of the impact limiter (which is constrained by the size of the tunnels and bridges that the package must pass through as previously described herein), the challenge to limit the deceleration of the cask under horizontal or near-horizontal drop is more acute. Limiting the peak g-load under the horizontal (side drop) or near-horizontal (slap-down) angled drop conditions is the governing condition in the impact limiter's performance. This is attributed to the fact that the fuel basket panels of the spent nuclear fuel canister inside the outer cask have relatively limited capacity to withstand the inertia load of the fuel assemblies in their weak (lateral) direction. In the longitudinal direction, there is no such dimensional constraint; hence vertical and oblique (center of gravity or CG over the corner) drop orientations do not pose a similar challenge. To overcome the challenge of limiting deceleration of the package from a horizontal or near-horizontal fall, a new perforated impact limiter design and configuration which may comprise a perforation aluminum ring or sleeve in one non-limiting embodiment is disclosed. The term "aluminum" is used in a generic sense in this document meaning pure aluminum or any of the many aluminum alloys available in the industry.

As further described below, the present perforated aluminum impact limiter is an assemblage comprising an essentially annular shaped cylindrical body of certain height and diameter that slides over the top and bottom ends of the cask's machined end flanges or forgings as further described herein. The impact limiter generally comprises an outer cap shell and an internal perforated core comprising in one embodiment an annular cylindrical perforated barrel or sleeve. The perforated sleeve may have a monolithic body comprising a central opening configured to slip over the top and bottom ends of the cask body. The "donut-shaped" perforated sleeve includes a plurality of elongated perforations forming longitudinal passages through the solid body of the sleeve. The passages have a greater longitudinal length than their respective diameters, as further described herein. The passages circumferentially extend 360 degrees around the entire sleeve in one embodiment. The longitudinal passages may be arrayed in a staggered pitch and may be tightly packed in one embodiment such that pitch spacing between adjacent perforations is not greater than the diameter of the smallest adjacent perforation. Accordingly, in one preferred pattern and pitch or hole spacing between perforations, a radial reference line drawn from the geometric center of the perforated sleeve outwards through the sleeve will intersect at least one perforation regardless of angular orientation of the reference line. In other words, the reference line cannot be drawn through any angular position from 0 to 360 degrees which will not pass through at least one perforation. The solidity ratio, "S" (defined as the ratio of the solid metal area formed by webs of material between the perforations to the total transverse cross-sectional area of the sleeve), provides the parameter that can be varied to achieve the required crush force resistance/crush performance.

In contrast to the cross-core honeycomb panel constructions of the past as previously described herein, solid aluminum as a non-limiting metal of choice in one preferred embodiment is universally commercially-available in a host of product forms and is obtainable in numerous common alloy compositions with well-characterized and known precise mechanical properties. Advantageously, this makes the crush or impact resistance of the impact limiter more readily amendable to engineering analysis and computer modeling, and more predictable in impact performance than composite structures such as the past honeycomb design. In contrast to wood-based impact limiters, the present aluminum impact limiter is essentially temperature-insensitive in the range applicable to cask transport conditions (−40 C to 100 C) and subject to only minimal change in their strength moduli under dynamic (impact) conditions.

The present perforated aluminum impact limiter has several critically important advantages over its honeycomb predecessor. Because aluminum is an isotropic material (i.e. identical values of mechanical properties in all directions), the impact limiter is assured to have essentially a radially symmetric crush property. In contrast, the honeycomb is an orthotropic material which imparts a certain variation in the crush characteristic of the impact limiter in the circumferential direction. Advantageously, an impact limiter with a radially symmetric crush strength provided by the present perforated aluminum sleeve design will deform uniformly regardless of the location of the impact force on the impact limiter unlike the honeycomb design. Unlike the honeycomb product, the present perforated aluminum impact limiter does not require any adhesives which therefore does not suffer in impact performance effectiveness in the event of a fire during transport or otherwise compared to its honeycomb counterpart.

FIGS. 1-24 depict various aspects of a nuclear waste transport cask 20 with impact protection according to the present disclosure. Cask 20 may be used for storing any type of radioactive high level nuclear waste, including spent nuclear fuel (SNF) or other forms of radioactive waste. The cask is constructed to provide radiation shielding to ameliorate the gamma and neutron radiation emitted by the decaying spent nuclear fuel (SNF) or other high level radioactive waste held in the inner fuel storage canister 30 contained inside the cask. Cask 20 may be any commercially-available storage and/or transport cask, such as for example without limitation HI-STAR or HI-STORM casks available from Holtec International of Camden, N.J. or other. The SNF canister 30 may be any commercially-available waste canister such as a multi-purpose canister (MPC) also available from Holtec International or other.

Cask 20 has a vertically elongated and metallic cylindrical body including an open top end 21, a bottom end 23, a cylindrical sidewall 24 extending between the ends, and an internal cavity 28. The cylindrical metallic SNF canister 30 (represented schematically by dashed lines and well known in the art) containing radioactive SNF fuel assemblies or other nuclear waste W is insertable into cavity 28 through top end 21, which is then closed by a bolt-on top lid assembly 25 to seal the cask 20. Cavity 28 extends for a full height of the cask in one embodiment. The cavity 28 is configured (e.g. transverse cross-sectional area) to hold only a single SNF canister 30 in one embodiment.

The upper and lower extremities of cask 20 further include top and bottom end forgings 37, 38. Top end forgoing 37 has an annular structure defining a central opening for inserting the SNF canister 30 therethrough into cavity 28 of the cask. Bottom end forgoing 38 has a solid disk-like structure defining a centrally-located and circular bottom baseplate 29. Baseplate 29 disposed at the bottom end of the cask body forms a floor and support surface inside cavity 28 on which the SNF canister is seated. The cask body 21 including the forgings 37, 38, and inner shell 24*a* (described below) may be formed of steel, such as stainless steel which is effective at blocking gamma radiation.

In one embodiment, baseplate 29 (bottom end forging 38) defines a downwardly open recess 29*a* which receives a circular disk-shaped radiation shielding plate 31 formed of radiation shielding material. The shielding material may be a boron-containing material such as Metamic® or Holtite™ (each a proprietary product of Holtec International of Camden, N.J.); the latter of which generally comprises hydrogen rich polymer impregnated with boron carbide particles for neutron shielding. Metamic® is a discontinuously reinforced aluminum boron carbide metal matrix composite material designed for neutron radiation shielding. Either shielding material is effective for neutron scattering/attenuation. Other neutron scattering/attenuation material may be used. In one embodiment, the radiation shielding plate 31 may be Holtite™.

Top lid assembly 25 may include a inner lid 26 and outer lid 27 in one embodiment. Both the inner and outer lids are recessed into the top end of the cask body 21, more particularly top end forging 37, such that the lids do not protrude above the top end 21 of the cask. Lids 26 and 27 may be stacked on top of each other in abutting contact in one arrangement. Inner lid 26 may have a smaller outer diameter than the outer lid 25 which allows each lid to be fastened to a different circumferentially-extending annular surface of the top end forging 37. Inner lid 26 may be bolted onto the top end forging 37 by a first circumferential array of threaded fasteners 28 such as bolts. Outer lid 27 may be bolted onto the top end forging of the cask by a second circumferential array of threaded fasteners 28 such as bolts which fall on a different bolt circle outside the bolt circle formed by the bolts for the inner lid. Inner and outer lids 26, 27 may be formed of metal such as steel (e.g. stainless steel in one embodiment) and has a substantial thickness selected to effectively block gamma radiation emitted by the canister 30. The inner and outer lids 26, 27 may be formed of steel such as stainless steel in some embodiments.

The sidewall 24 of cask 20 may be formed by multiple vertically elongated cylindrical shells and radiation shielding materials. Alternatively, sidewalls 24 may be collectively formed by a plurality of axially aligned and vertically stacked cylindrical shell segments seal welded together at the joints therebetween to form an elongated shell assemblage. In one embodiment, the cask body may be a composite construction generally comprising a structural inner shell 24*a*, intermediate gamma shield 24*b*, and outer neutron shielding jacket 40. Shell 24*a*, gamma shield 24*b*, and jacket 40 may be generally annular and cylindrical in shape, and are concentrically aligned with each other and longitudinal axis LA of cask 20.

Inner shell 24*a* may be formed of a structural metal such as steel (e.g. stainless steel or other) which forms the innermost part of sidewall 24 whose interior surface forms the cavity 28 of the cask which holds nuclear waste canister 30. The intermediate gamma shield 24*b* may be formed of a radiation shielding material, and more particularly a gamma shielding material effective for blocking gamma radiation emitted by the SNF stored in nuclear waste container 30 held inside the cask 20. Intermediate shield 24*b* may be formed of lead of suitable thickness in some embodiments. However, other dense gamma blocking materials such as concrete, copper, suitably thick steel, etc. may alternatively be used as some non-limiting additional examples. The inner shell 24*a* and gamma shield 24*b* may be in substantial conformal contact in some embodiments as shown, or alternatively may be radially spaced apart forming an annular gap therebetween. Both the inner shell and gamma shield formed of dense steel and lead material types described above are each effective for gamma blocking applications. The inner steel shell 24*a* provides the bulk of the structural support of the cask sidewall 24 and is welded to top and bottom end forgings 37, 38.

The cylindrical outer neutron shielding jacket 40 extends perimetrically and circumferentially around the sidewall 24 of cask 20 between the top and bottom ends of the cask. The jacket may extend longitudinally for substantially the entire height of the cask. The jacket 40 may be formed of a boron-containing neutron shielding material such as Metamic® or Holtite™ (each a proprietary product of Holtec International of Camden, N.J.). These materials were previously described herein and are effective for neutron scattering/attenuation. In one embodiment, the jacket may be formed of Holtite™. Other neutron scattering/attenuation material may be used. In some constructions, the jacket 40 may be formed by two or more arcuate segments which are coupled together such as via welding or mechanical fastening methods. An outer metallic shell enclosure 41 which encases the neutron shielding jacket 40 may be provided in some embodiments for protection of the neutron shielding material.

Outward facing upper and lower impact load bearing surfaces 35, 36 are formed by exposed side portions of top and bottom end forgings 37, 38 of cask 20 above and below the neutron shielding jacket 40 in one embodiment as shown. The end forgings may be seal welded to the top and bottom ends of the inner shell 24*a*. Bearing surfaces 35, 36 extend circumferentially around the entire perimeter of the cask and face radially/laterally outwards. In one embodiment, the bearing surfaces may be formed by annular stepped portions 22 of the cask sidewall 24 at the top and bottom ends 21, 23 of the cask 20. The bearing surfaces 35, 36 represent reduced diameter stepped end portions of the cask 20 formed by the end forgings 37, 38 having a smaller outside diameter than the outside diameter of shielding jacket 40 on the main middle portion of the cask sidewall. Bearing surfaces 35, 36 are therefore recessed radially inwards from the adjoining full diameter portions of the cask sidewall 24 below the upper bearing surface 35 and above the lower bearing surface 36 as shown.

Pairs of upper and lower lifting lugs or trunnions 32 may be provided for lifting, transporting, and loading the cask 20 onto the rail car or other movable carrier via a motorized cask crawler typically driven by tank-like tracks for hauling the extremely heavy casks (e.g. 30 ton or more). Such robust cask crawlers are well known in the art without need for further elaboration and conventionally used for transporting and raising/lowering casks at a nuclear reactor facility (e.g. power generation plant or other) or interim nuclear waste storage facility. Cask crawler transporters are commercially-available from manufacturers such as J&R Engineering Co. of Mukwonago, Wis. (e.g. LIFT-N-LOCK®) and others. The trunnions 32 are rigidly attached to the inner steel shell 24*a* of the cask 20 such as via welding or another rigid coupling method.

The top and bottom impact limiters 50 according to the present disclosure will now be described. FIGS. 13-24 show the impact limiters and aspects thereof in greater detail.

Each impact limiter 50 generally comprises an outer protective cap shell 51, impact-absorbing core comprising perforated sleeve 80, and annular closure plate 70. Cap shell 51 in one embodiment includes a circular end wall 52 and a cylindrical sidewall 53 extending longitudinally from the end wall parallel to longitudinal axis LA of cask 20. End wall 52 defines an outer surface 58 including a plurality of fastener openings 57 to access fasteners used to secure the impact limiters 50 to cask 20, as further described herein. An innermost end of sidewall 53 opposite the end wall 52 (i.e. end of the sidewall proximate to cask 20 when impact limiter is mounted) defines an annular edge 59.

Figure 29:
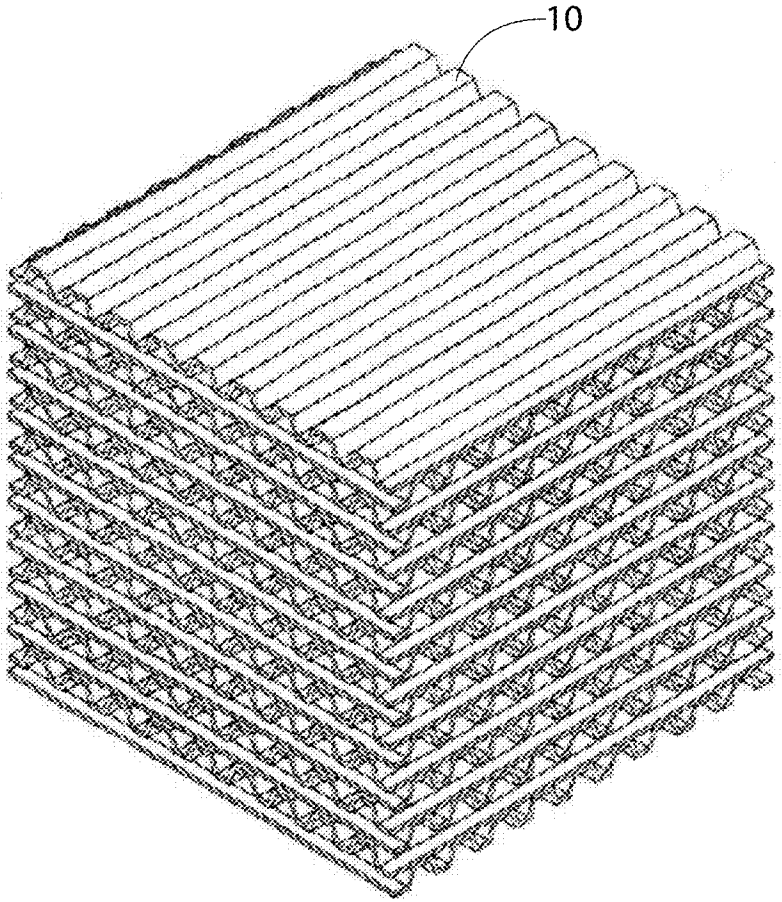
FIG. 29 (PRIOR ART)
FIG. 29 shows the core structure of a prior impact limiter design.

Cap shell 51 defines an internal end cavity 51*a* which is filled with a suitable energy absorbing material 45 that is crushable to dissipate external impact forces which might be caused by an end drop of the cask 20 (i.e. vertical drop on cask on end or slight oblique angle thereto). The energy absorbing material 45 may be a suitable preferably fire-resistant energy absorbing substance or structural assemblage. In one embodiment, the energy absorbing material may be a conventional honeycomb impact limiter formed by cross-laid corrugated aluminum panels 10 as previously described herein and shown in FIG. 29. In this application, the honeycomb arrangement of panels is used for cask end impact situations while side drop impact protection is provided by the perforated sleeves 80 further described herein collectively forming a hybrid impact limiter. The panels 10 would be oriented such that the plane of each panel is oriented perpendicularly to longitudinal axis LA of the cask (i.e. cross-wise). Open areas between the panels would therefore be arranged in the lateral/radial direction, not longitudinally. In another embodiment, the energy absorbing material 45 may be a crushable polymeric foam material of suitable density (e.g. polyethylene, etc.). In one embodiment, the energy absorbing material 45 may fill the end cavity 51*a* such that the material has a longitudinal thickness substantially greater than perforated sleeve 80, and may comprise a majority of the total longitudinal height of the cap shell 51. In some cases, the shell 51 may further provide structural support to the impact limiter assembly. In one construction, an annular spacer 71 may be provided which forms an annular gap between the end wall 52 of the cap shell 51 and the perforated sleeve 80 to space the sleeve longitudinally apart from the end wall (see, e.g. FIGS. 14-15).

Cap shell 51 may be formed of a suitable metal, such for example without limitation thin gauge stainless steel. Other metal materials including suitable gauge aluminum or other can be used. The cap shell provides a protective outer skin that encloses the energy-absorbing perforated sleeve 80 and energy absorbing material 45 at the outboard ends of the impact limiters 50 which shields the sleeve and energy absorbing material from minor damage, fire, and weather during transport and handling.

Cap shell 51 includes a centrally-located cylindrical collar 55 defining an open circular receptacle 56. Collar 55 projects inwardly in a longitudinal direction from the end wall 52 of the cap shell towards the cask 20. Collar 55 is spaced radially inward from sidewall 53 to define an open annulus 54 configured for receiving and mounting perforated sleeve 80 therein. Sleeve 80 becomes fully nested within the annulus 54 and cap shell 51 when positioned in the impact limiter 50. Perforated sleeve 80 is located inboard of end wall 52 for both the top and bottom impact limiters. Once the perforated sleeve is mounted in annulus 54, closure plate 70 may be welded to annular edge 59 and/or collar 55 to retain the sleeve in the cap shell.

The impact limiters 50 may be detachably mounted to the lid assembly of the cask 20 via a plurality of threaded fasteners 60 such as bolts. Fasteners 60 may be supported by a circular metallic bolting plate 64 positioned inside circular receptacle 56 formed in the cap shell 51 by collar 55. Fasteners 60 project towards the cask 20 from bolting plate 64 in receptacle 56 to threadably engage corresponding threaded sockets or bores 61 formed in the upper outer lid 27 and the baseplate portion of the bottom end forging 38 when the top and bottom end forgings of cask 20 are insertable received in central receptacle 56 of the impact limiters. The enlarged heads of the bolts do not pass through bolting plate which may be welded to the collar 55 while the threaded shanks of the bolts pass through respective openings in the bolting plate to project inwards from the bolting plate to threadably engage the cask (see, e.g. FIGS. 14 and 15). Bolting plate 64 may be formed of a suitably strong metal, such as without limitation carbon or stainless steel for strength. The bolting plate 64 is compressed by the impact limiter fasteners 60 against the uppermost exposed outer lid 27 of cask 20 at top and radiation shielding plate 31 at the bottom of the cask when the impact limiter 50 is detachably coupled thereto.

Bolting plate 64 may be spaced longitudinally apart from energy absorbing material 45 in one embodiment. A circular radiation shielding disk 63 with bolt holes may be interposed between bolting plate 64 and the energy absorbing material. Radiation shielding disk may be formed of a radiation shielding material effective for neutron attenuation, such as without limitation Holtite™ previously described herein. Other neutron absorbing materials or gamma blocking materials such as lead may be used in other embodiments depending on the radiation shielding needs. In other embodiments, the shielding disk 63 may be replaced by a disk of thermal fire-resistance insulation for added protection of the cask against a fire event. Longitudinally-extending fastener openings 57 formed through the energy absorbing material 45 of each impact limiter provide access to the fasteners 60 for tightening and coupling the impact limiters 50 to the cask 20. The bottom radiation shielding plate 31 of cask 20 may also include a plurality of longitudinally-extending fastener openings 62 which permit the fasteners to reach and access the threaded bores 61 in the bottom end forging 38 (see, e.g. FIG. 15).

Figure 13:
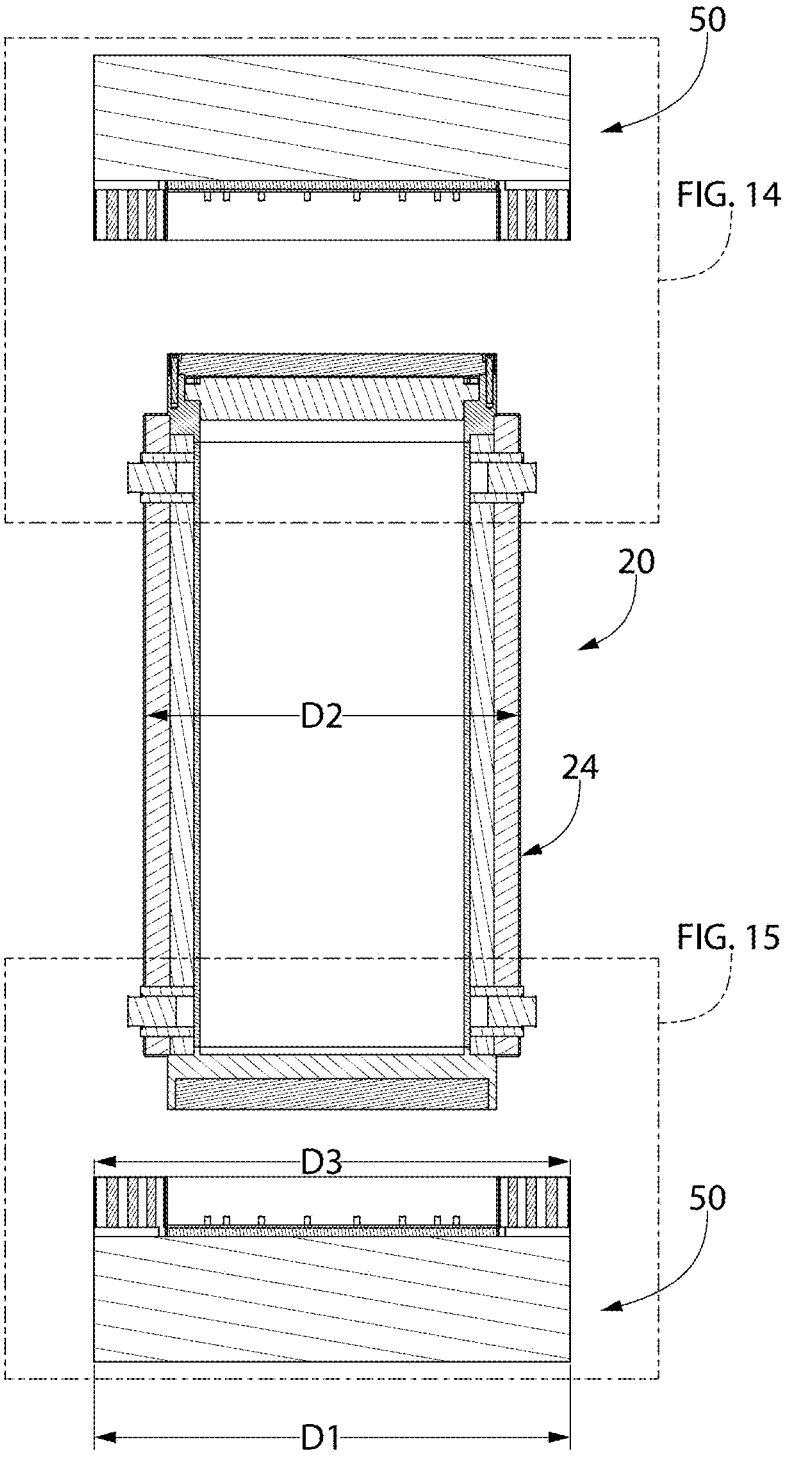
FIG. 13 is a longitudinal cross sectional view thereof.
Figure 14:
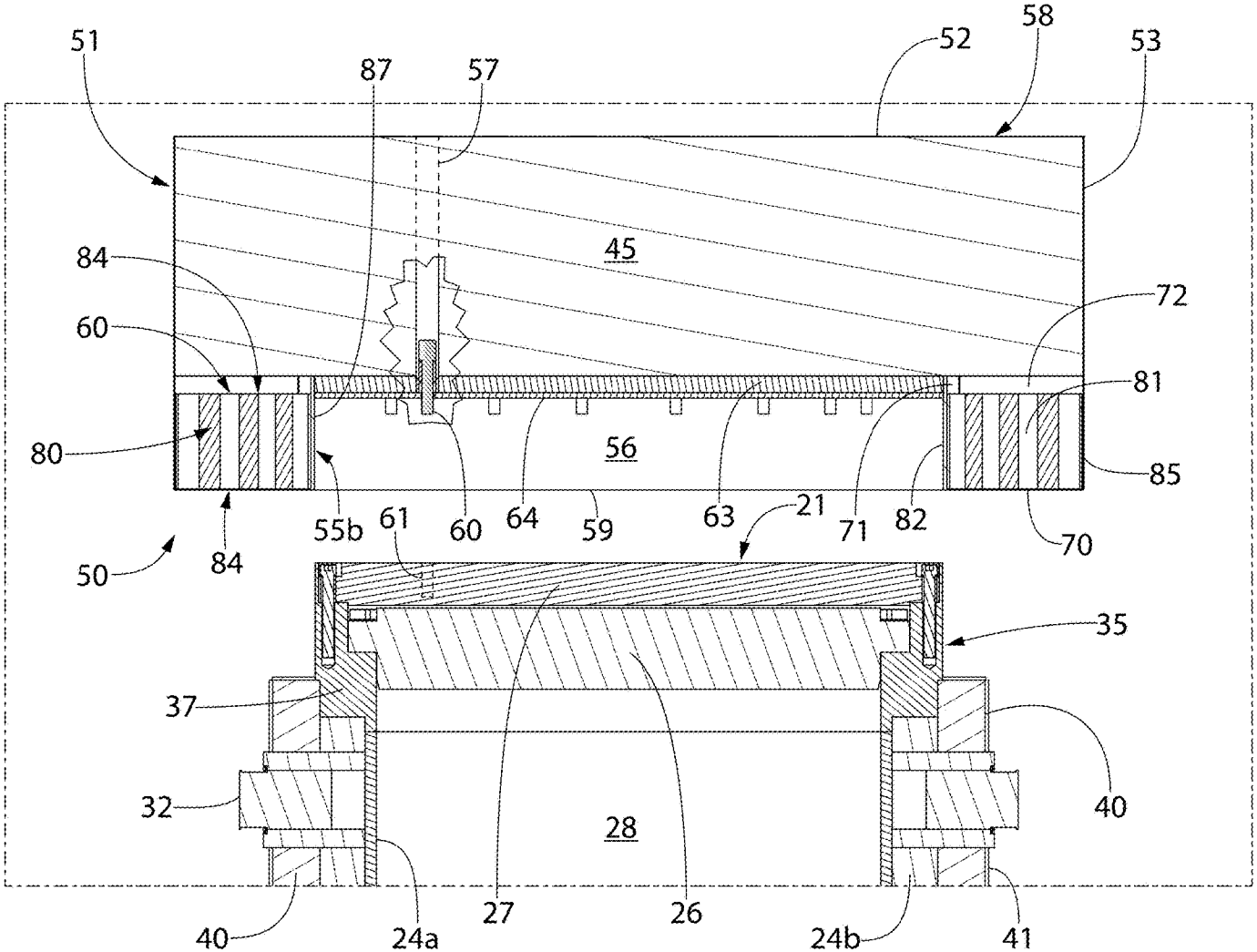
FIG. 14 is an enlarged top detail taken from FIG. 13.
Figure 15:
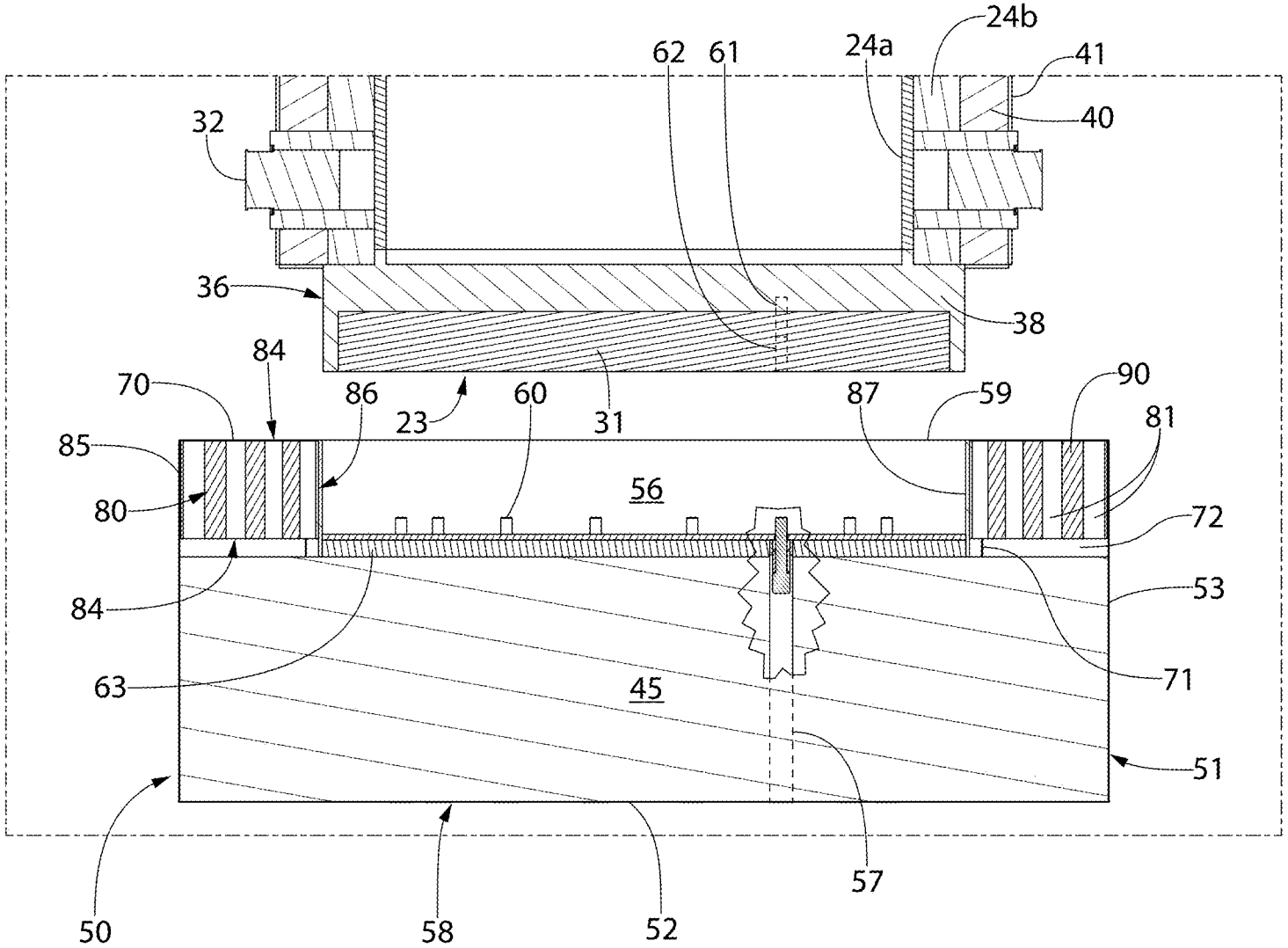
FIG. 15 is an enlarged bottom detail taken from FIG. 13.
Figure 16:
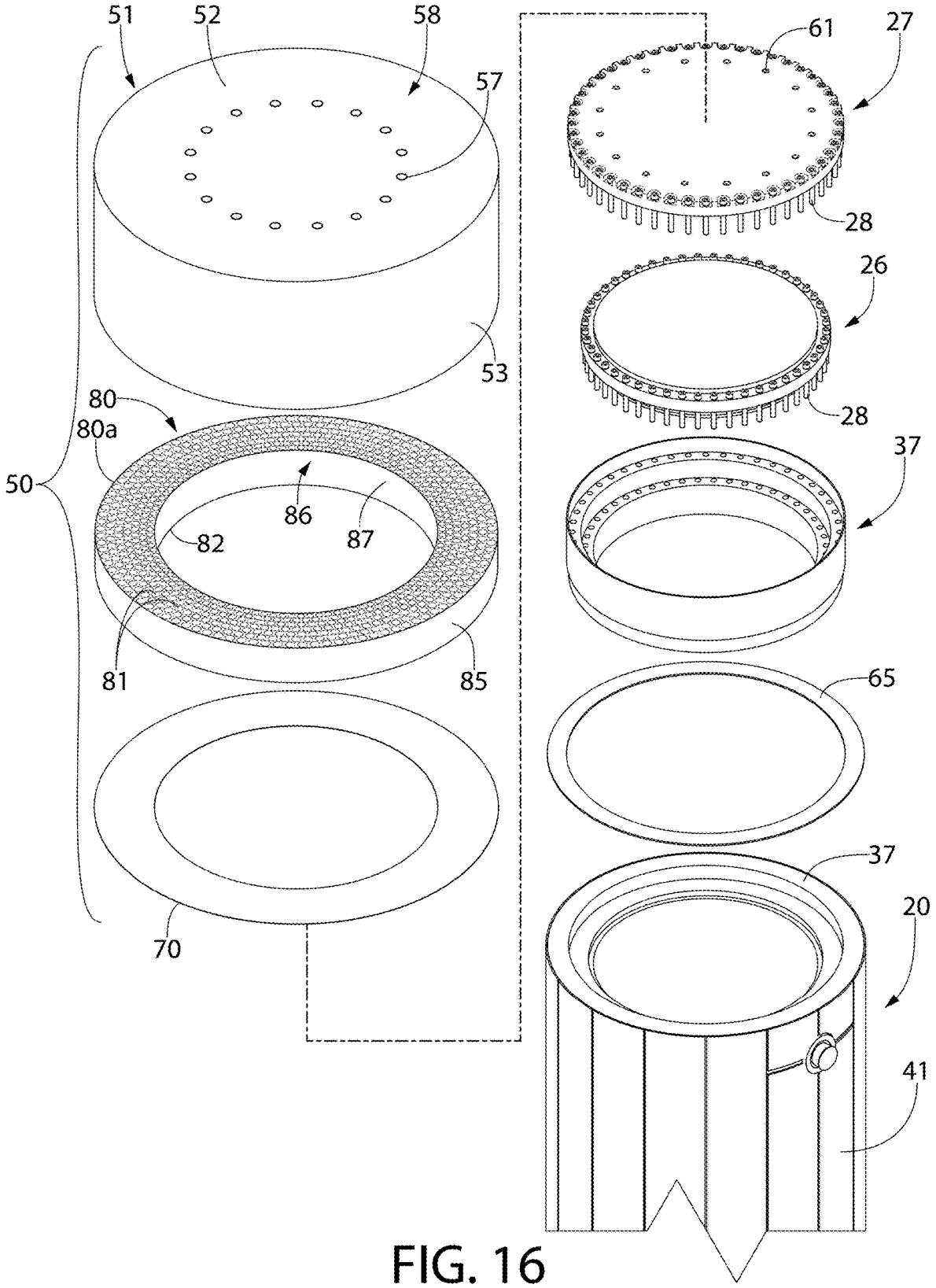
FIG. 16 is an exploded top perspective view of the upper portion of the cask and impact limiter.
Figure 17:
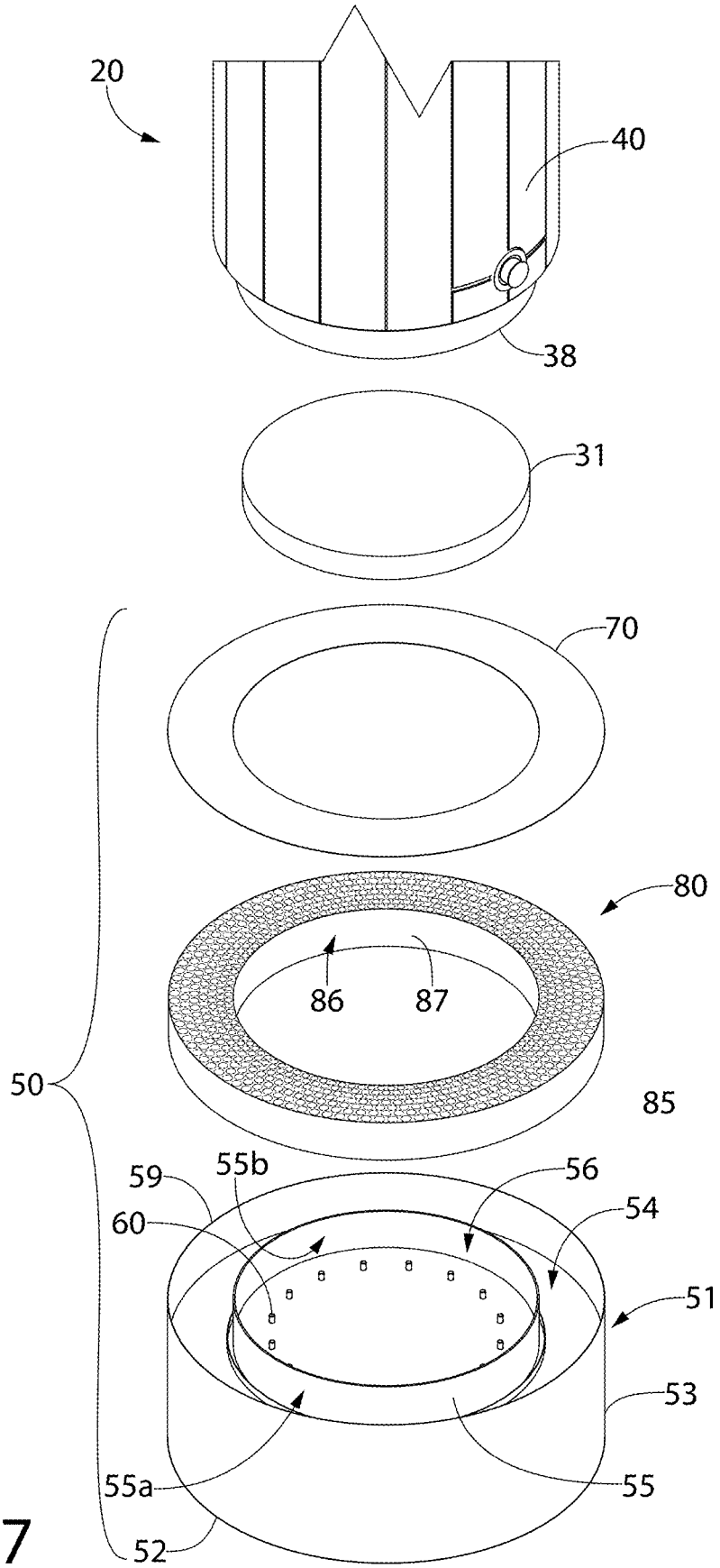
FIG. 17 is an exploded bottom perspective view of the lower portion of the cask and impact limiter.
Figure 18:
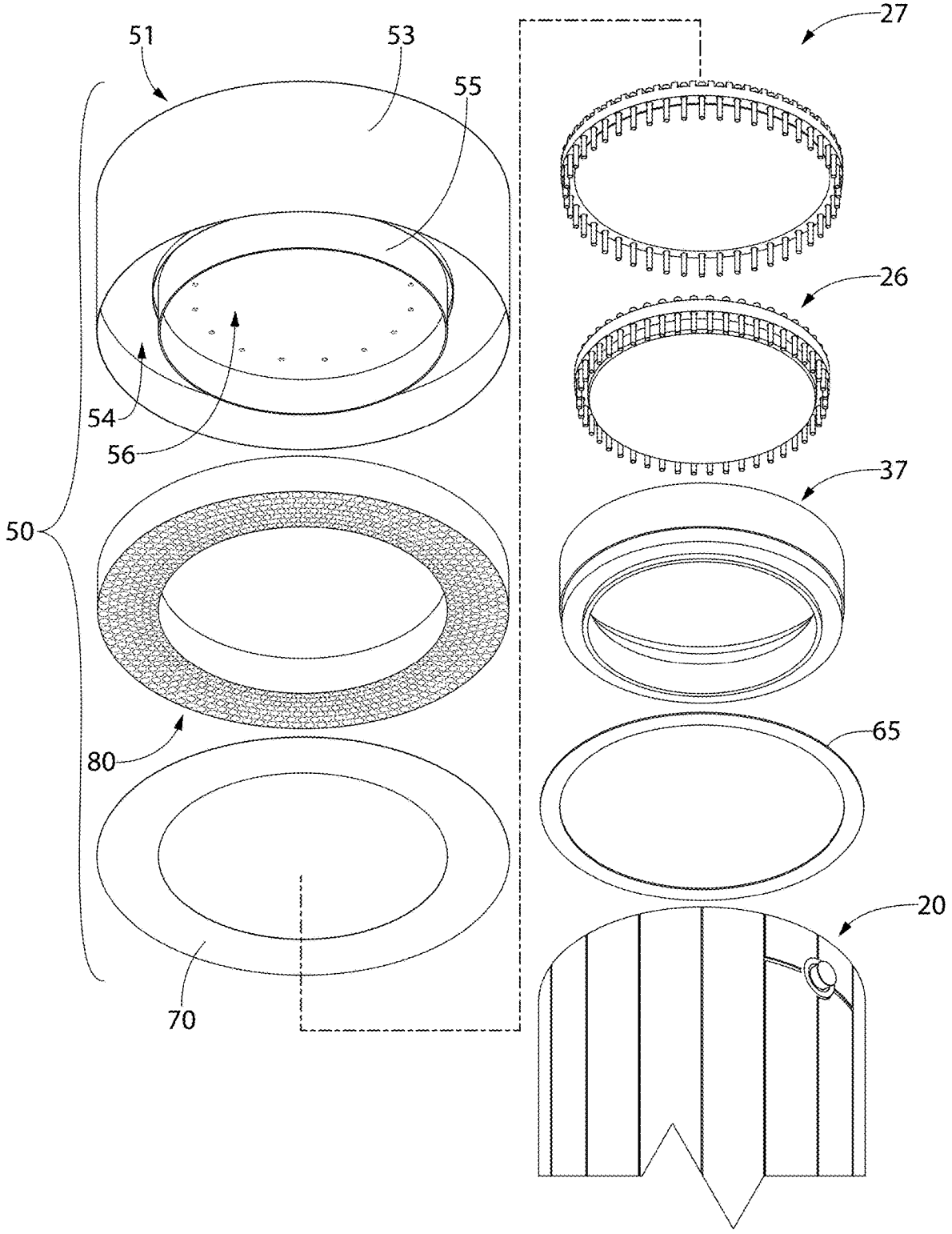
FIG. 18 is an exploded bottom perspective view of the upper portion of the cask and impact limiter.
Figure 19:
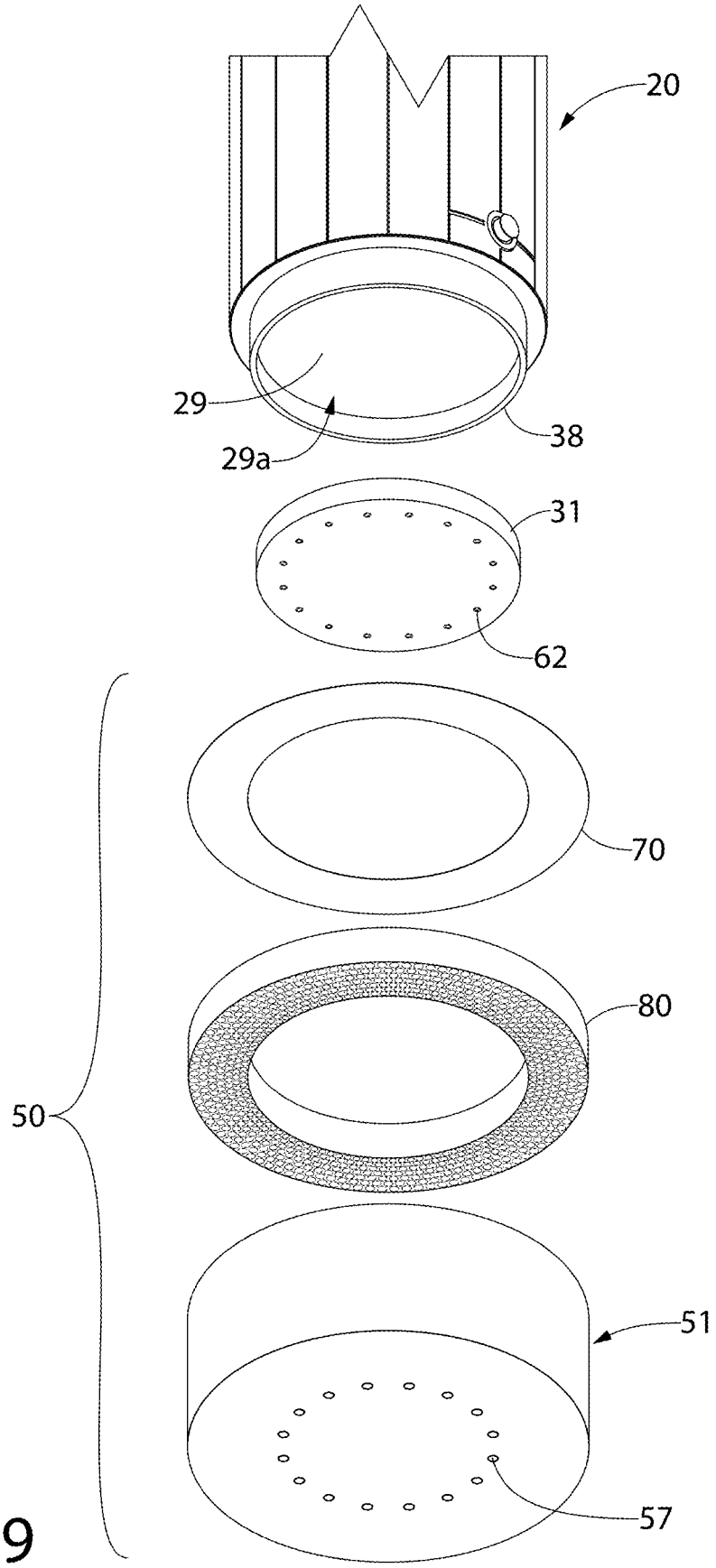
FIG. 19 is an exploded bottom perspective view of the lower portion of the cask and impact limiter.
Figure 20:
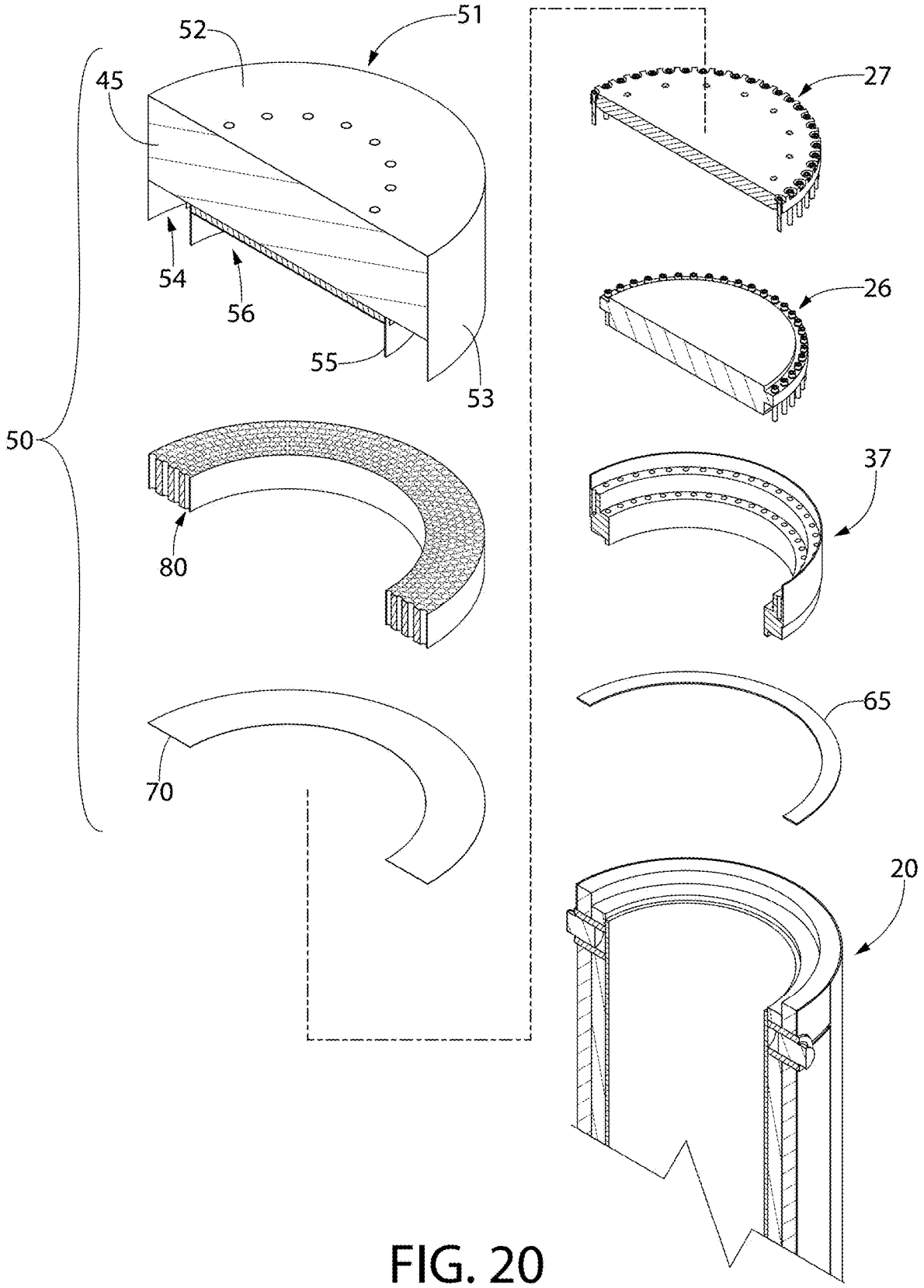
FIG. 20 is an exploded top cross-sectional perspective view of the upper portion of the cask and impact limiter.
Figure 21:
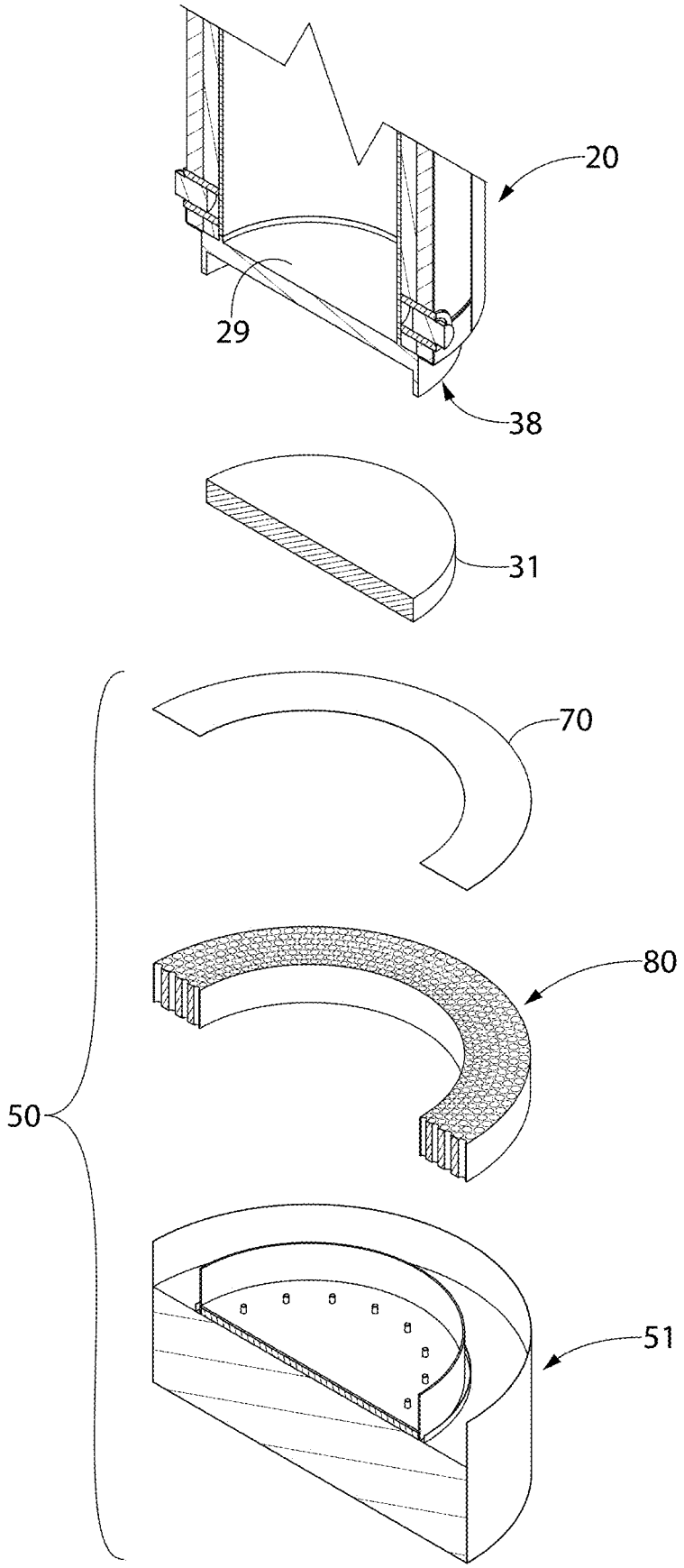
FIG. 21 is an exploded top cross-sectional perspective view of the lower portion of the cask and impact limiter.

When mounted on cask 20, the impact limiters 50 have an outside diameter D1 which is larger than the outside diameter D2 of the cask (defined by the exterior surface of radiation shielding jacket 40 (identified in FIG. 13). The outside diameter D3 of the perforated sleeve 80 similarly is larger than cask outside diameter D2. Accordingly, the impact limiters are configured to each protrude radially outward beyond the body of cask to protect the cask if dropped. The deformable impact limiters, and not the cask, will first strike the impact surface (e.g. ground or concrete slab generally) to absorb and dissipate the impact force or kinetic energy of the fall.

Perforated sleeve 80 may have an annular body 80*a* formed of a base metal such as without limitation aluminum or aluminum alloy in one non-limiting preferred embodiment. The body may be a solid metal monolithic body of unitary structure in one embodiment. This construction advantageously allows the perforated sleeve to absorb and mechanically deform in response to an external impact force as an integral solid unit in a directionally uniform manner.

Figure 30:
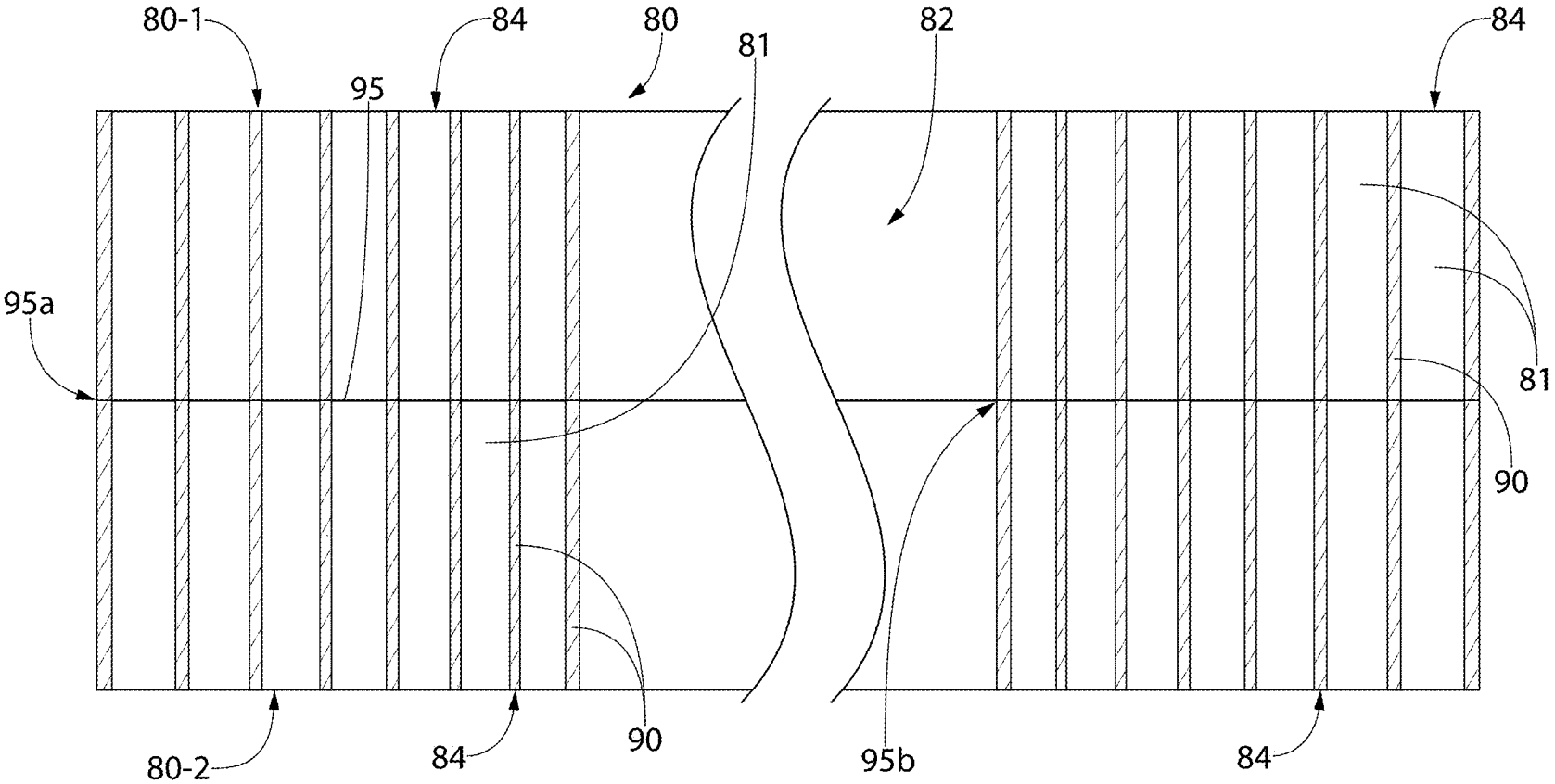
FIG. 30 is a side cross-sectional of another embodiment of a perforated sleeve of the impact limiter having a composite construction formed by welding multiple ring segments of sleeves together at their inner and outer peripheries.

In other possible constructions, the body of perforated sleeve 80 may be formed by composite construction formed by multiple stacked and welded annular metal ring segments having the same mounting and impact absorbing features as the monolithic sleeve described further below. FIG. 30 shows one non-limiting example of such a composition construction. The segmented perforated sleeve comprises at least two ring segments 80-1, 80-2 which are abuttingly engaged and stacked upon each other at a flat-to-flat interface between mating major end surfaces 87 of the ring segments which form a joint 95 therebetween. The segments 80-1, 80-2 may be welded together at their inner and outer circumferential peripheries. More specifically, welds may be formed between the annular abutting outer circumferential walls 85 of the abutted segments at the exposed outboard portions 95*a* of the joint 95. Welds may also be formed between the annular abutting inner circumferential wall 87 within central opening 82 of the segments 80-1, 80-2 at the exposed inboard portions 95*b* of the joint. Intermittent stitch welds spaced circumferentially apart or full circumferential welds may be used to permanently join the ring segment; both welding methods of which are well known in the art without further explanation. The composite perforated sleeve 80 may be built in segments to the desired height of the sleeve by permanently joining a suitable number of segments together of individual height. The array of collapsible perforations in each ring segment would be concentrically aligned with each other in the stack to form continuous longitudinal passages 81 which extend for the full height of the stack and perforated sleeve 80.

With continuing general reference now to FIGS. 1-24, the perforated sleeve body 80*a* may comprise a central opening 82 and a circumferential array of perforations comprising elongated longitudinal passages 81 formed between flat and parallel opposing major end surfaces 84 of the body. Central opening 82 receives the top and bottom ends 21, 23 of cask 20. Passages 81 may extend completely through the major end surfaces in one non-limiting preferred embodiment; however, in other possible embodiments the passages 81 may extend only partially through annular body of the sleeve. Cylindrical outer circumferential wall 85 and inner circumferential wall 87 extend longitudinally between the major end surfaces 84 of the perforated sleeve 80 parallel to longitudinal axis LA. The inner circumferential wall 87 of perforated sleeve 80 defines an inward facing annular load transfer surface 86 which engages the annular outer surface 55*a* of collar 55 facing outward towards annulus 54 when the sleeve is positioned in the annulus of impact limiter 50. The opposite annular inner surface 55*b* of collar 55 facing inward toward receptacle 56 is positioned to engage the top and bottom outward facing annular impact load hearing surfaces 35, 36 of cask 20 when the impact limiters 50 are installed on the cask.

Figure 10:
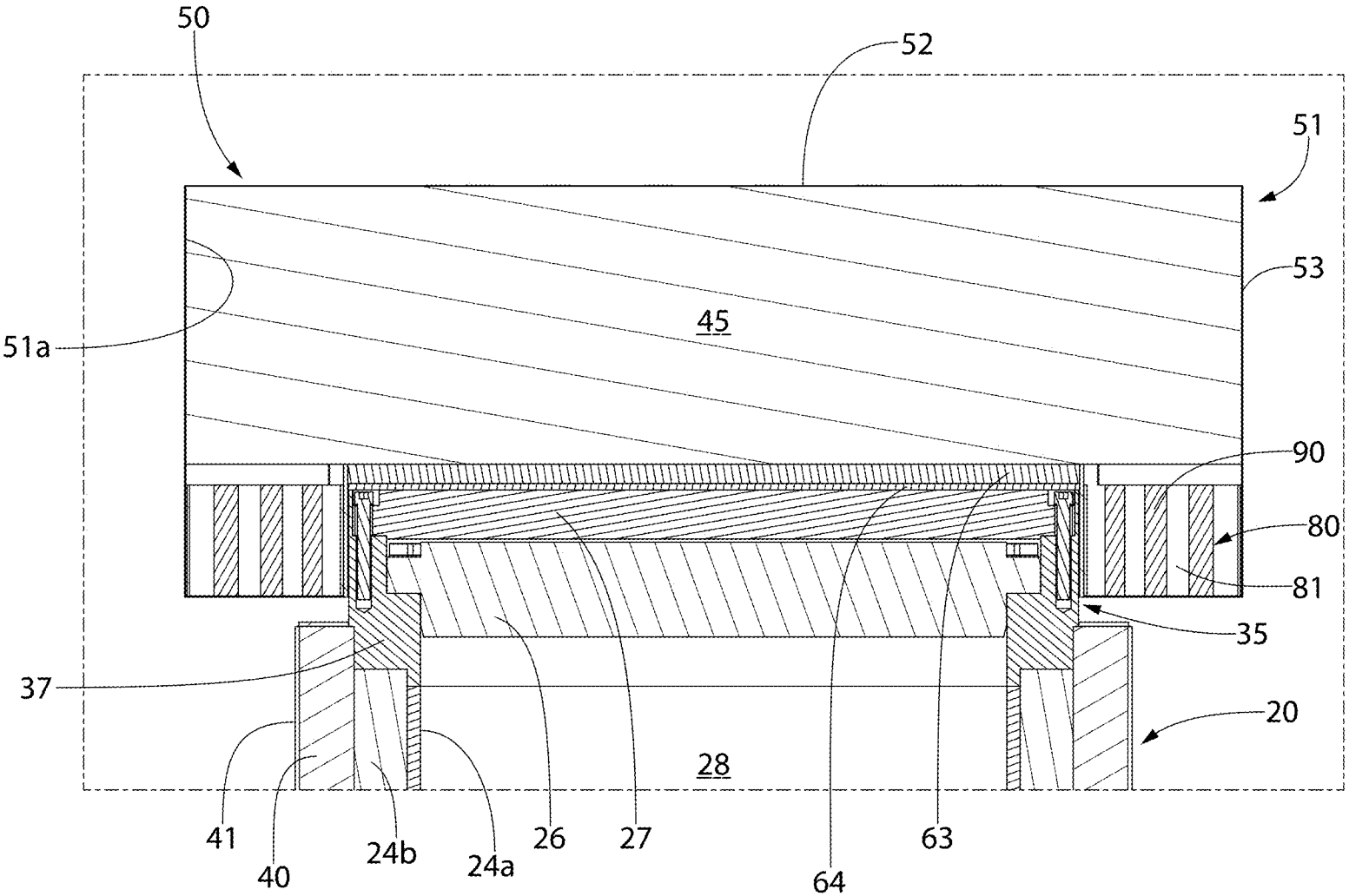
FIG. 10 is an enlarged top detail taken from FIG. 9.
Figure 11:
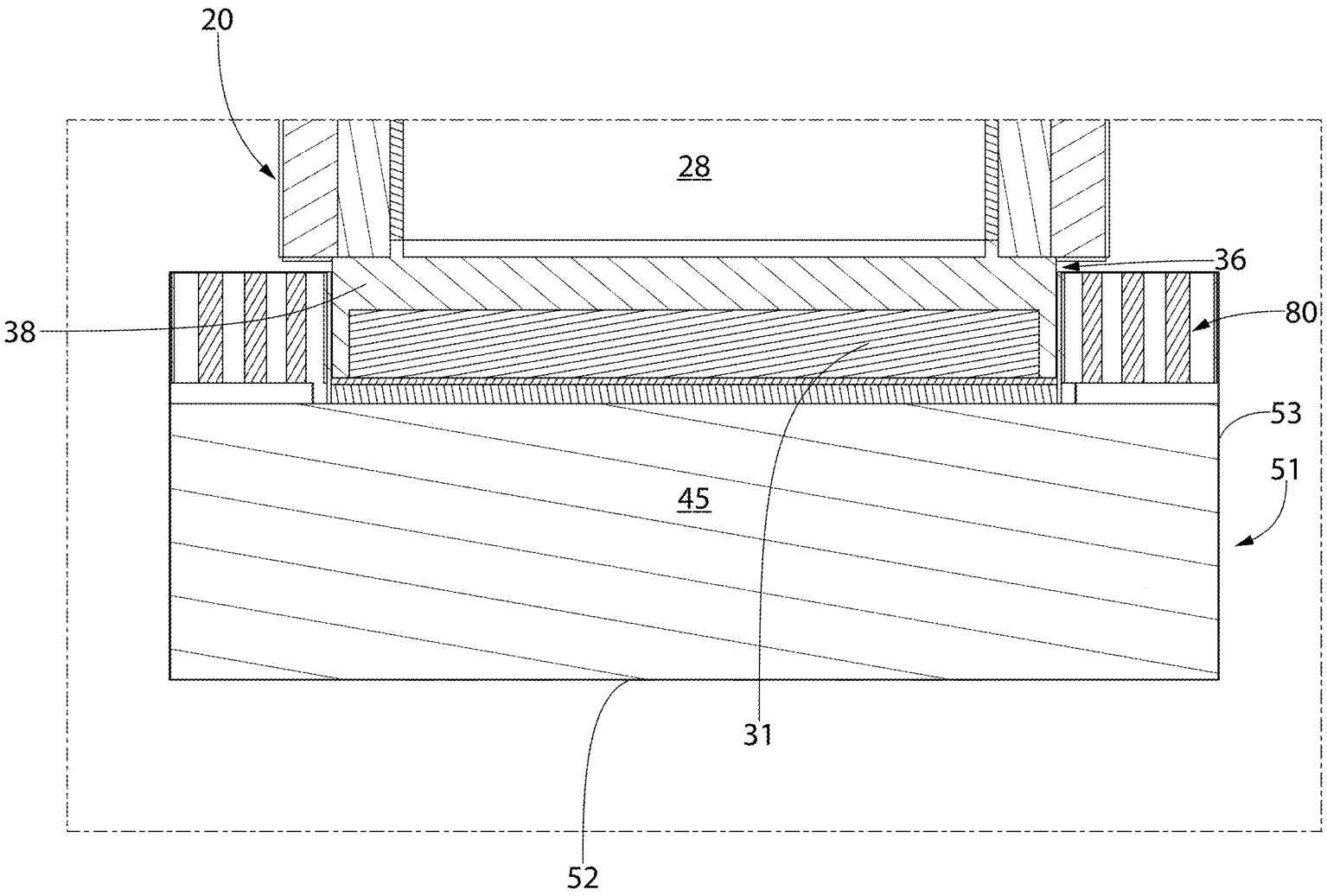
FIG. 11 is an enlarged bottom detail taken from FIG. 9.
Figure 12:
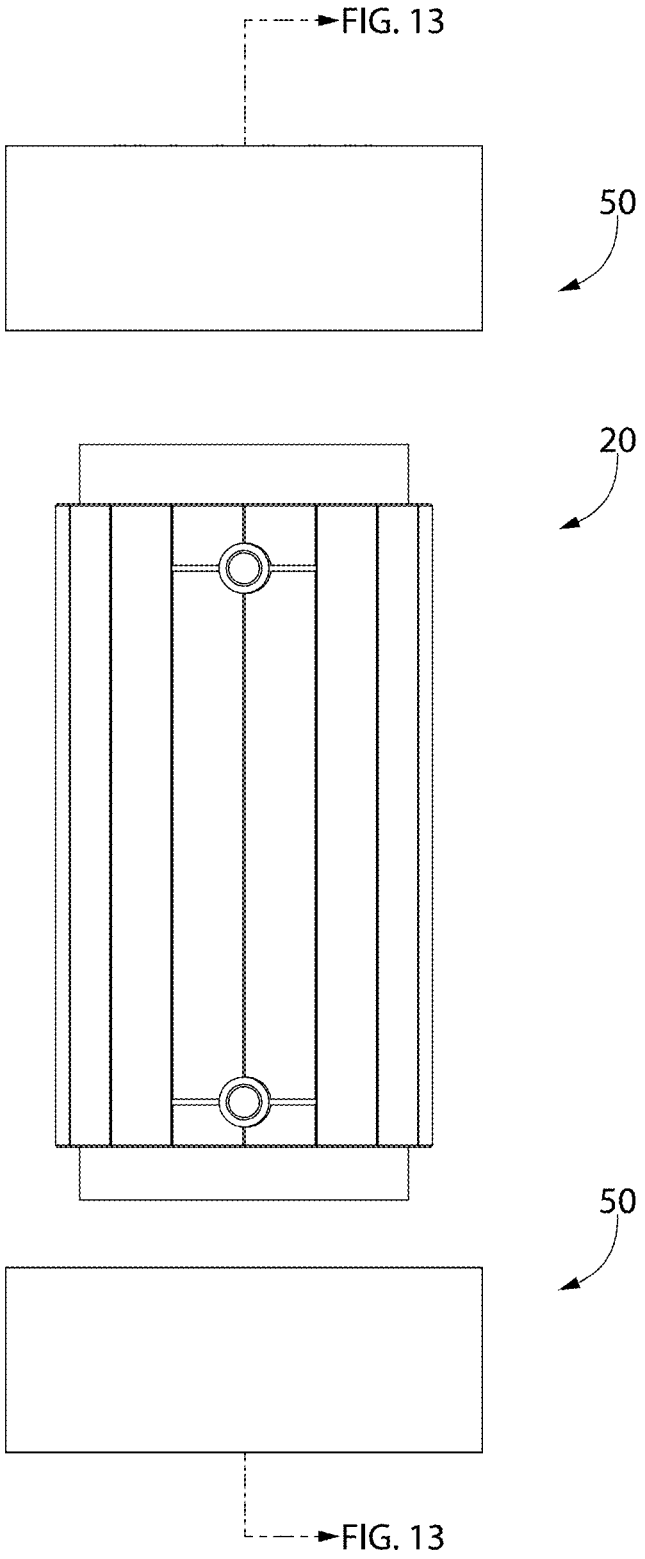
FIG. 12 is an exploded side view of the cask and impact limiters of FIG. 1.

The impact sleeve 80, collar 55, and bearing surfaces 35, 36 of the cask are laterally/radially aligned when the impact limiters 50 are mounted on the top and bottom ends of the cask (see, e.g. FIGS. 10-11). This allows the radially inward directed impact load or force resulting from an impact event to be distributed radially through the impact sleeve 80 to the cask to be absorbed by the more structurally robust top and bottom end forgings 37, 38 rather than the steel inner shell 24*a*, lead intermediate gamma shield 24*b*, and outer boron-containing neutron shielding jacket 40. These latter components are structurally weaker in the radial/lateral direction and/or thinner in lateral thickness than the end forgings 37, 38 as shown, and hence are more susceptible to damage due to impact loads which could breach the nuclear waste containment package (i.e. cask). Radially acting external impact forces are transmitted through in turn (from outside to inside) the impact sleeve 80, to collar 55, and finally to the cask load bearing surfaces 35, 36 of the cask end forgings 37, 38.

With continuing reference to FIGS. 13-24, the longitudinal passages 81 may be oriented parallel to each other and extend between major end surfaces of the perforated sleeve 80. Accordingly, none of the passages may intersect any other passages. In one embodiment, the longitudinal passages may further be oriented parallel to the longitudinal axis LA of the cask when mounted thereon. In such an orientation, passages 81 are oriented perpendicular to the opposing major end surfaces 84 of the perforated sleeve 80. Longitudinal passages 81 may have a circular transverse cross section which allows them to be readily formed by drilling the solid metallic body of the perforated sleeve. However, other cross-sectional shapes are possible. The passages may each have a longitudinal length Lp which is greater than their respective diameter Dp (see, e.g. FIGS. 23-24). In some non-limiting preferred embodiments, the longitudinal passages each have a length Lp greater than at least two times their respective diameter Dp. This allows formation of a longitudinally thick perforated sleeve 80 for greater lateral and oblique impact resistance, and protection of the cask 20 in surviving falls. The end wall 52 of impact limiter 50 may have a longitudinal thickness which is at least twice the longitudinal thickness of perforated sleeve 50 in some embodiments.

Figure 23:
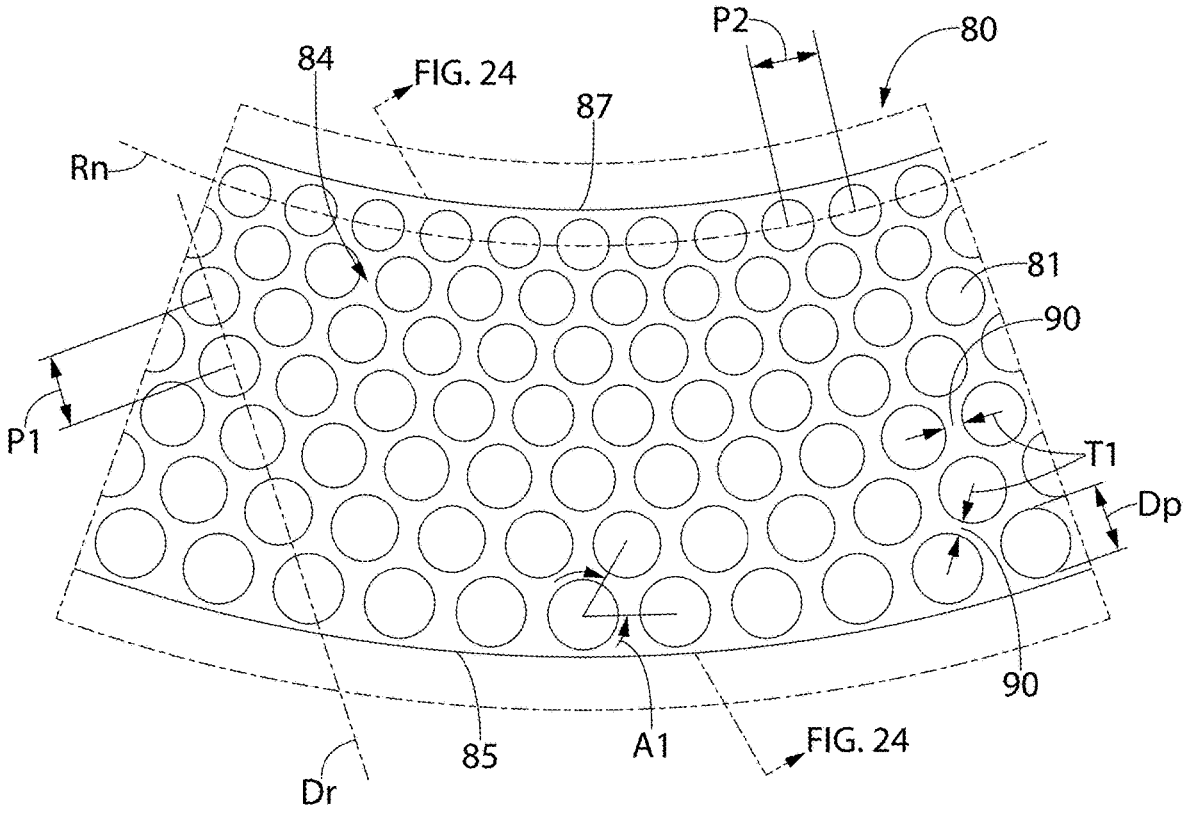
FIG. 23 is an enlarged detail taken from FIG. 22.

The array of longitudinal passages 81 of perforated sleeve 80 may be dispersed in a full 360 degree pattern around an entirety of the perforated sleeve as best shown in FIG. 23. In one embodiment, the array of longitudinal passages 81 may be arranged in multiple circumferentially-extending concentric rings Rn of longitudinal passages which extend circumferentially around the perforated sleeve. In some embodiments, at least 3 rings Rn may be provided. In the non-limiting illustrated embodiment, 7 rings are shown. Any suitable number of rings may be provided depending on the radial width of the perforated sleeve 80, diameter Dp of the longitudinal passages 81, and other design factors. Longitudinal passages 81 in each ring Rn may be uniformly spaced apart in one implementation.

The longitudinal passages 81 may be arrayed in a triangular staggered pitch or hole pattern as best shown in FIG. 23. In certain embodiments, a 60 degree hole pattern may be used in which passages 81 in adjacent rings Rn are located at an acute angle A1 of 60 degrees to each other. Other angles and hole patterns may be used. The staggered hole pattern allows a maximum number of passages 81 to be formed in perforated sleeve 80 due to the circumferentially offset positioning of passages between adjacent rings Rn (i.e. a passage 81 in the next inward or outward adjacent ring Rn to a present first ring under consideration is located between each of two passages in a first ring as shown). The result is a tightly packed pattern of longitudinal passages 81 in the perforated sleeve 80, thereby concomitantly maximizing the open area which can be provided to control and maximize the deformability of the sleeve to absorb lateral drop-induced impact loads/forces.

The longitudinal passages 81 in each concentric ring Rn may have progressively larger diameters than the inwardly immediate adjacent ring of longitudinal passages such that the diameters increase in size moving radially outwards from the geometric center C of perforated sleeve 80 through the rings. Accordingly, in such a constructions, longitudinal passages 81 of an outermost ring Rn each have larger diameters than those in an innermost ring of longitudinal passages closest to the geometric center C and central opening 82 of perforated sleeve 80. Longitudinal passages 81 in diagonal rows Dr of passages 81 in the sleeve may be spaced at a hole pitch P1 which progressively gets larger between each adjacent ring Rn of passages moving in a radially outward direction from the central opening 82. In additional, the pitch P2 between longitudinal passages 81 in each concentric ring of passages may also become progressively larger moving in a radially outward direction. Accordingly, the pitch P2 between passages 81 in the outermost ring Rn is larger than pitch P2 between passages in the innermost ring.

Figure 22:
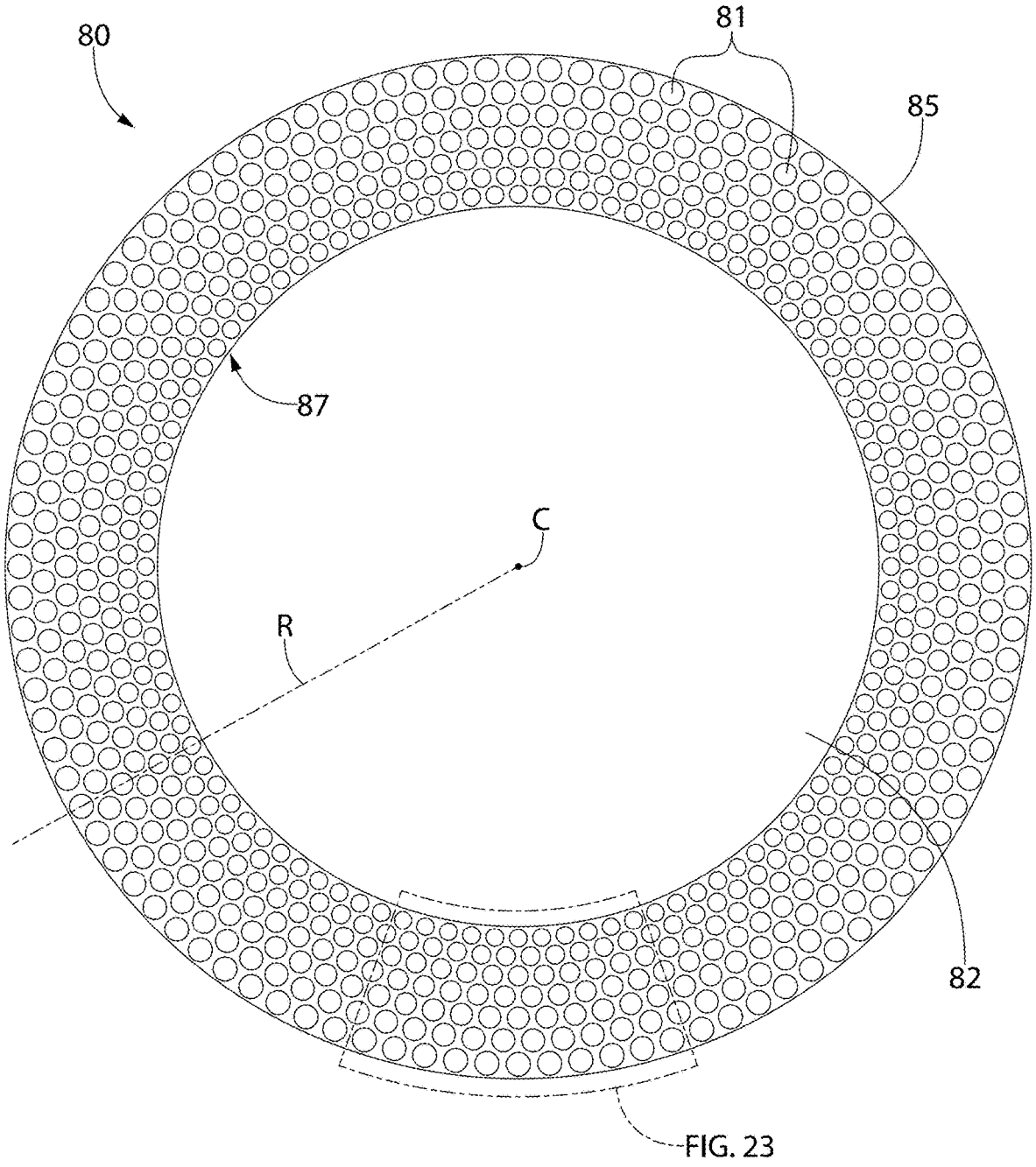
FIG. 22 is a top plan view of the perforation sleeve of the impact limiter.
Figure 24:
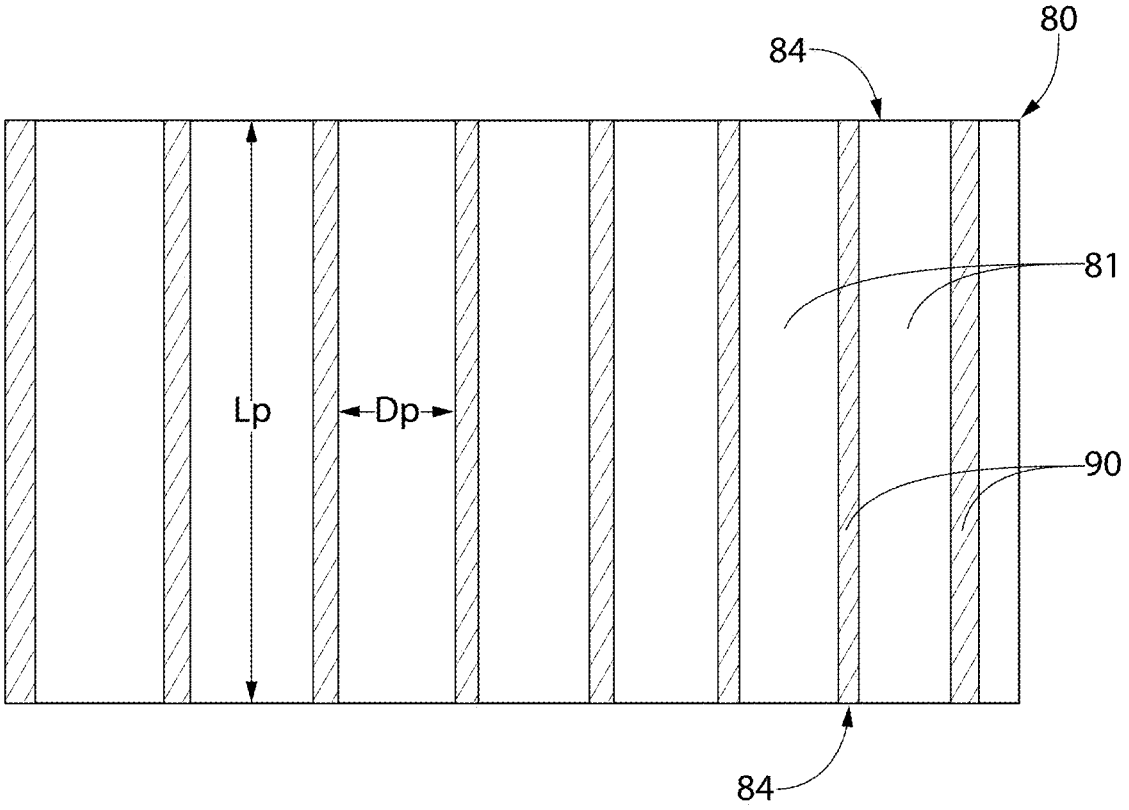
FIG. 24 is transverse cross sectional view taken from FIG. 23.

Referring to FIGS. 22-24, longitudinal passages are separated by a relatively thin ligament or web 90 of material of the solid metallic body of the perforated sleeve 80. A web thickness T1 is defined between adjacent longitudinal passages 81 which is measured perpendicularly to the passage lengths Lp as shown in FIG. 23 (perpendicularly to longitudinal axis LA of cask). The webs 90 extend fully between the opposing major surfaces 84 of the perforated sleeve between the passages 81. In various embodiments, the webs 90 between adjacent passages 81 may preferably be smaller in thickness T1 than the diameter Dp of the largest diameter longitudinal passage, and more preferably smaller than the smaller diameter longitudinal passage (i.e. innermost ring Rn of passages). The thin webs 90 in conjunction with the hole pattern and pitch (spacing) between longitudinal passages 81 result in a tightly packed perforations such that a radial reference line R drawn from the geometric center of the perforated sleeve 80 outwards through any portion of the sleeve will intersect at least one perforation regardless of angular orientation of the reference line.

The solidity ratio "S" is defined as the ratio of the solid metal area formed by the webs 91 of material between the longitudinal passages 81 divided by the total transverse cross-sectional area of the perforated sleeve 80 (calculated across major end surfaces 84 perpendicular to longitudinal axis LA). In one non-limiting preferred embodiment, the solidity ratio S may be less than 0.5 resulting in an open area of the sleeve 80 collectively formed by the longitudinal passages 81 being greater than 50% and solid areas concomitantly being less than 50%. The greater the open area, the generally greater the ability of the perforated sleeve to deform under lateral impact loads or forces acting perpendicularly (lateral/horizontal cask drop) or obliquely (angled cask drop) to the longitudinal axis LA of cask 20. In other embodiments where less deformability might be required, the open area of sleeve 80 may be less than 50% and solid area greater than 50% resulting in more solid area (i.e. solidity ratio greater than 0.5). As previously noted herein, the solidity ratio provides the engineering parameter that can be varied to achieve the required crush force resistance/crush performance of the perforated sleeve.

It bears noting that other hole patterns (e.g. square, etc.), other non-polygonal or polygonal hole shapes (e.g. oblong slots, ellipses, squares, rectangles, triangles, hexagons, etc.) and hole pitches may be used in other embodiments contemplates. Accordingly, the invention is not limited to the hole shape, hole pattern, or pitches described herein.

Computer Testing/Analysis of Perforated Sleeve

To evaluate the crush performance of the perforated aluminum perforated sleeve 80 of impact limiter 50 disclosed herein in lateral drop scenarios, a 109 metric ton cask protected during a lateral (horizontal) drop event (per 10 CFR 71.73) by the perforated sleeve was computer analyzed. This so-called free drop accident postulates a fall from 30 feet onto an essentially rigid surface. The following impact limiter geometry was computer modeled: Inner diameter of cylinder=86.75 inches; Outer diameter=123.75 inches; and Longitudinal Thickness (longitudinal major end surface to major end surface=13.0 inches"). The raw workpiece comprising a 6061-T6 aluminum ring (illustrated in FIGS. 22-24) was drilled with 7 rows of circular longitudinally-extending holes to form the longitudinal passages 81. The diameters of the passages range from 2.125 inches (innermost passages) to 2.875 inches (outermost passages) with an increment of 0.125 inch between adjacent circumferential concentric rings Rn previously described herein. There are 100 longitudinal passages 81 of same diameter in each row. The solidity ratio "S" of the perforated aluminum ring or sleeve used for the impact limiter was 0.455.

Figure 25:
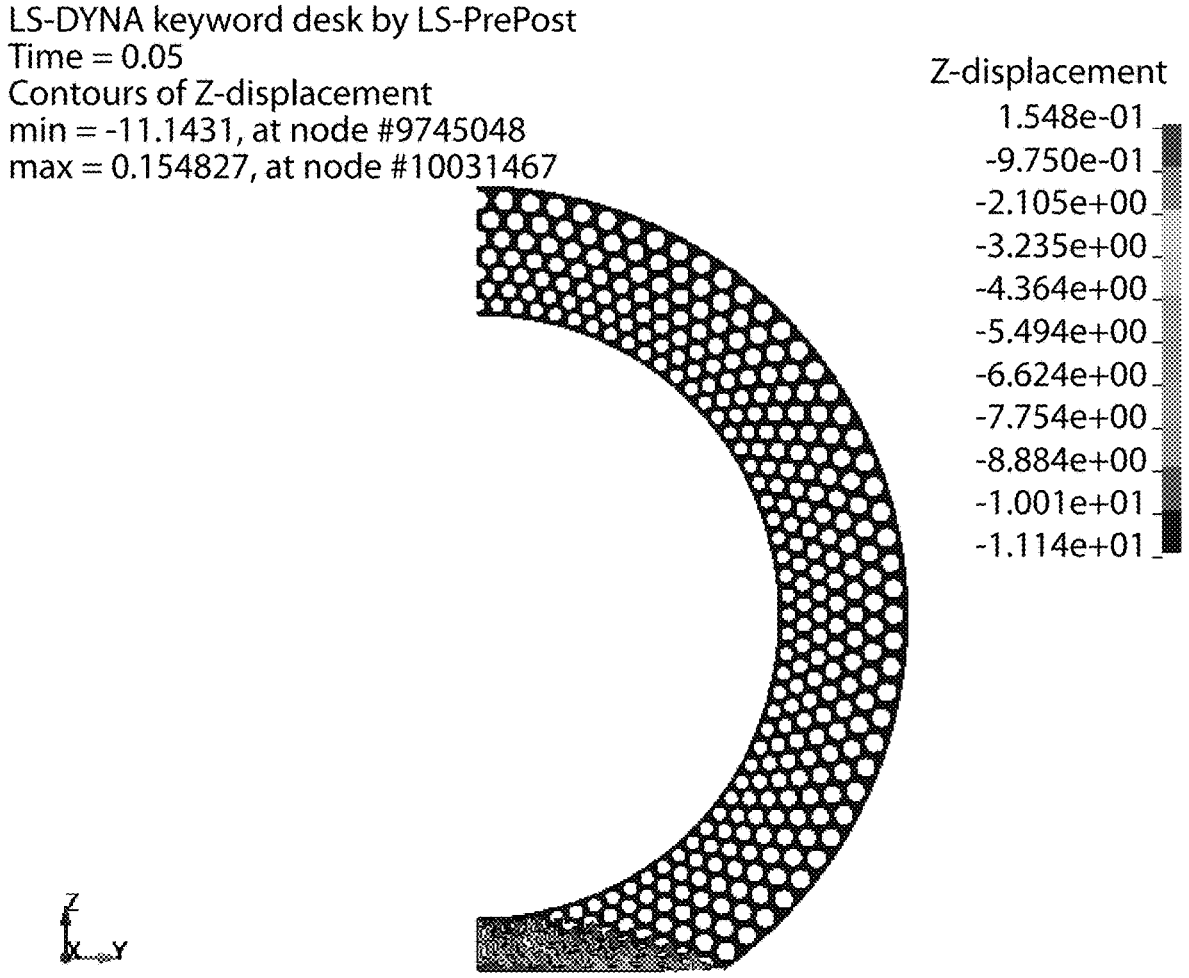
FIG. 25 is a computer generated image of the perforated sleeve after a drop test showing the deformed shape of the sleeve in the impact/crush zone.
Figure 26:
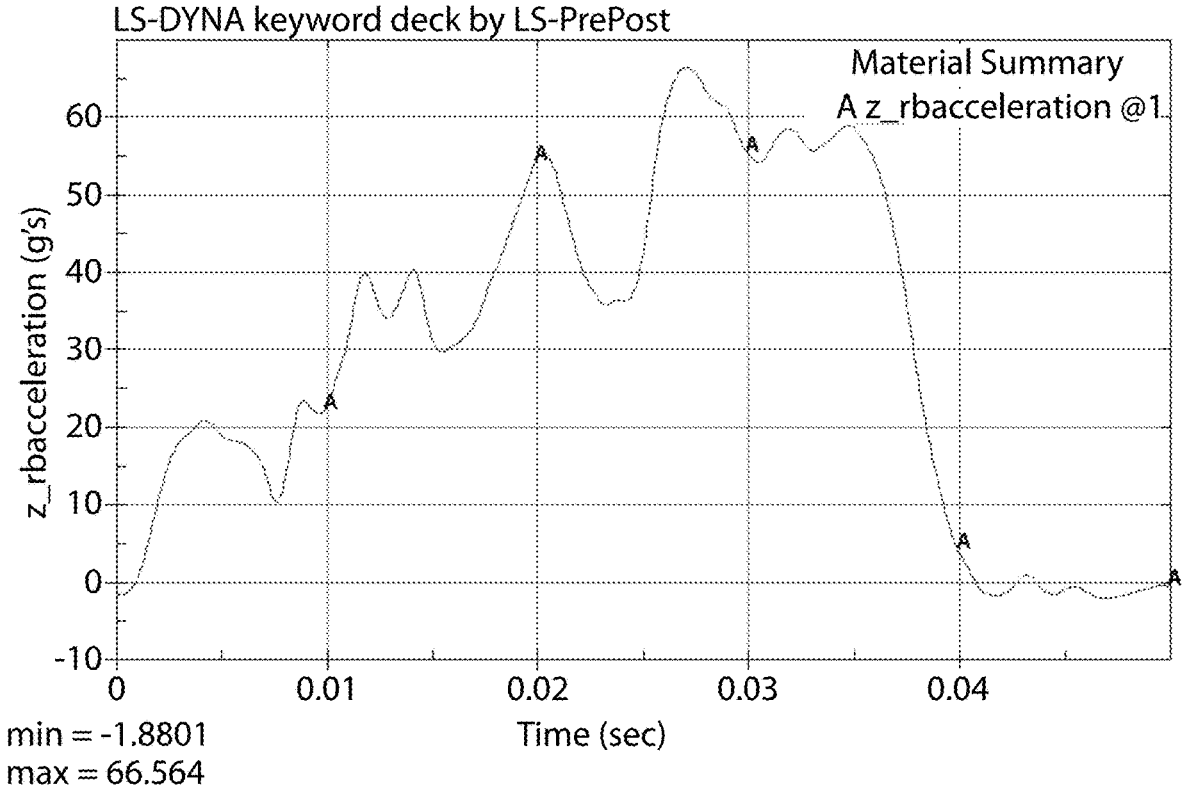
FIG. 26 is a computer generated graph from the drop test showing the impact deceleration time history of the cask.
Figure 27:
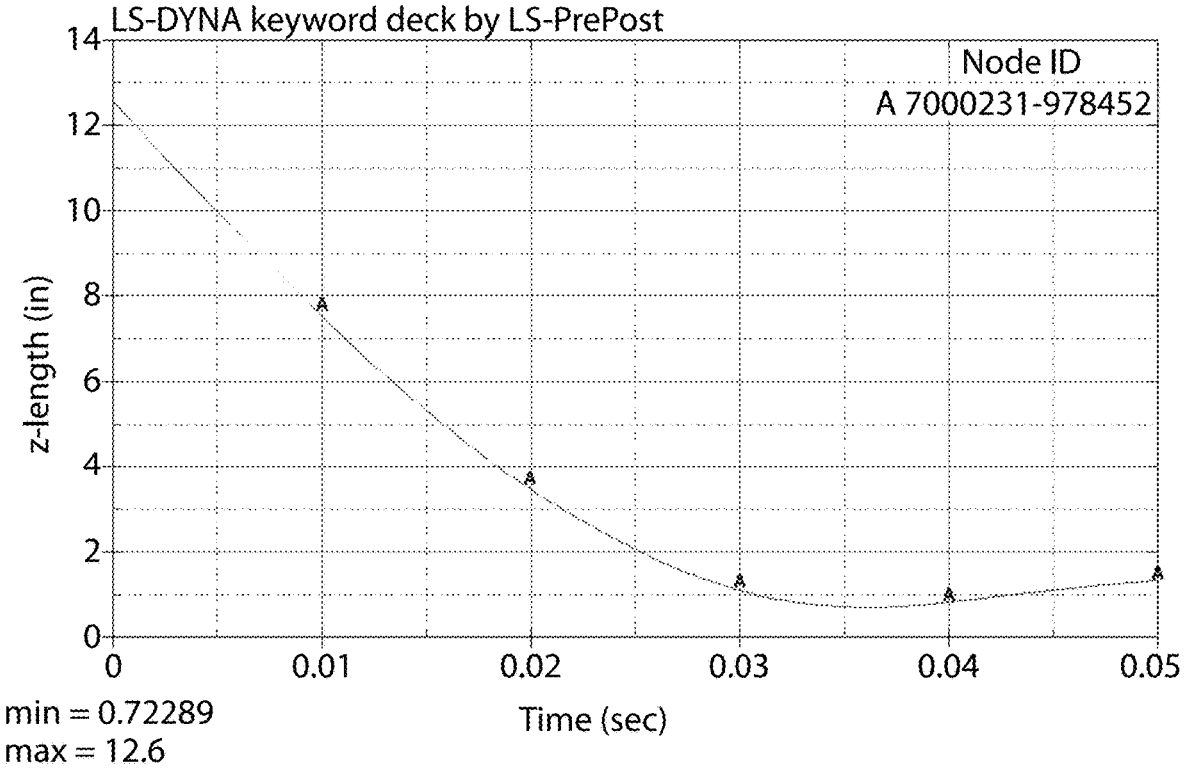
FIG. 27 is a computer generated graph from the drop test showing the cask to ground (impact surface) time history.

The 30-feet lateral (horizontal) drop event is simulated on the computer code LS-DYNA. FIG. 25 shows the deformed crushed shape of the impact limiter after the impact event. FIGS. 26 and 27 respectively show the impact deceleration-time history plot of the cask and the cask to ground (target surface) time history (a zero gap at the end of the impact is undesirable). FIG. 26 shows the peak deceleration to be limited to about 65 g's which indicates excellent impact limiter performance for this class of problems.

Figure 28:
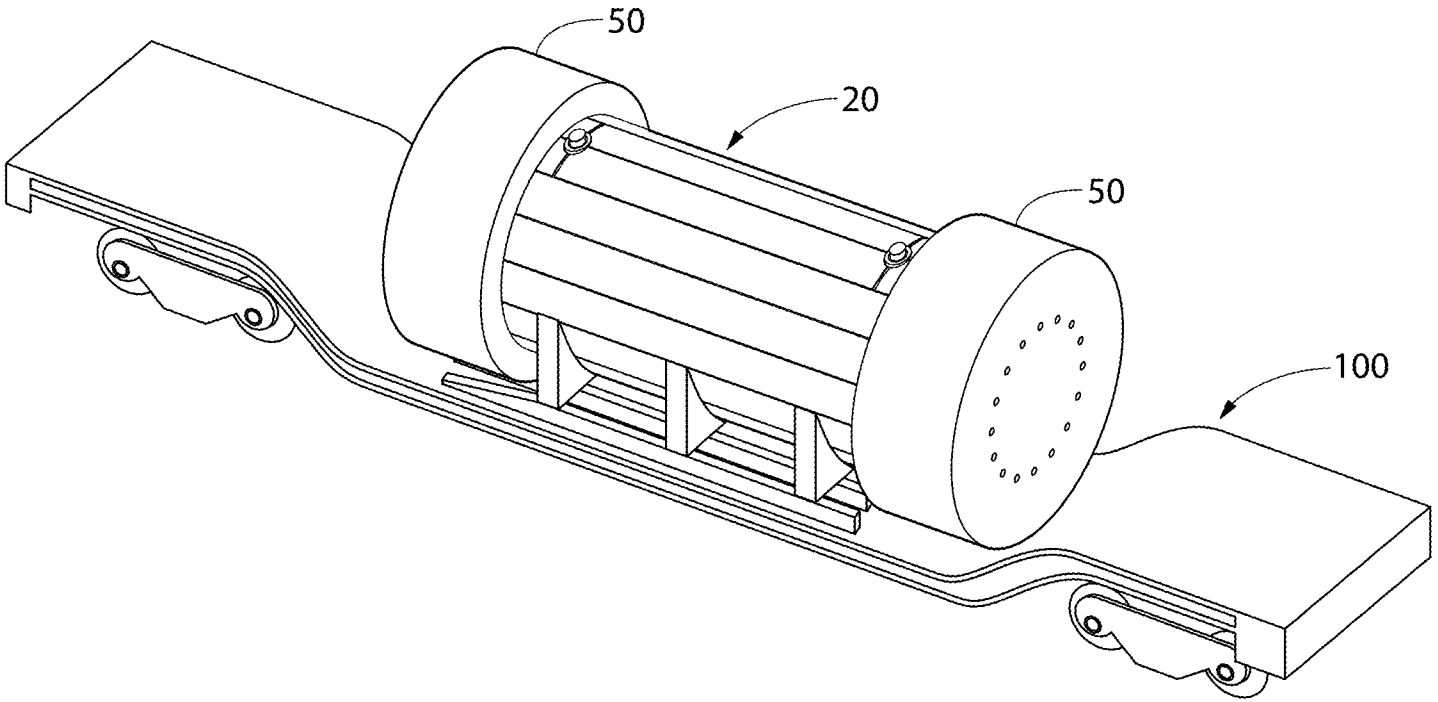
FIG. 28 shows the cask with installed impact limiter loaded on a transport rail car.

FIG. 28 shows cask 20 with impact limiters 50 on each end loaded onto a typical low-body rail car 100 ("low boy") for transport. Cask 20 is transported in the horizontal position as shown to the intended destination site.

Aspects and contemplated variations of the impact limiter 50 utilizing the perforated ring or sleeve 80 are as follows. The perforated sleeve 80 may be made of a perforated aluminum that can be used to efficiently extract the kinetic energy from a falling transport package—cask, so as to limit the deceleration suffered by its contents including the nuclear waste container 30 with spent fuel assemblies (SNF) contained therein. Typical aluminum materials that are suited for this application inn constructing the perforated sleeve 80 include without limitation pure aluminum (Al 1100), alloy 5052, alloy 6061 and alloy 6063, among others. Collectively, these materials are referred to as "soft isotopic" metallic materials. The perforated sleeve 80 can be manufactured by machining (e.g. drilling or other method) the soft-isotopic material castings or plates to form the longitudinal passages 81. Extruding blocks of the soft-isotopic material to form the ring shaped base material or workpiece prior to machining the passages may also be used. While circular perforations (longitudinal passages 81) in transverse cross section are desirable due to simplicity in their formation, the perforations in sleeve 80 can be other cross-sectional shaped including without limitation square, hexagonal or another fabricable geometric shape. Finally, in lieu of a cylindrical sidewall 85 as shown herein (i.e. straight and parallel to longitudinal axis LA), the perforated sleeve 80 can have other shaped sidewalls such as without limitation a frustoconically tapered or stair-cased (multi-stepped) sidewall in the radial direction to obtain the desired crush-force relationship.

While the foregoing description and drawings represent some example systems, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A nuclear waste cask with impact protection comprising:

a longitudinal axis;

a longitudinally elongated cask body including a top end, a bottom end, and a sidewall extending between the ends, and a cavity configured for holding a nuclear waste canister; and an impact limiter coupled to the top end of the cask body, the impact limiter comprising an annular perforated sleeve having a body including a central opening and a circumferential array of elongated longitudinal passages formed therethrough around the central opening.

2. The cask according to claim 1, wherein the longitudinal passages are oriented parallel to each other and extend between a top surface and a bottom surface of the perforated sleeve.

3. The cask according to claim 2, wherein the longitudinal passages are oriented parallel to the longitudinal axis of the cask.

4. The cask according to claim 2, wherein e longitudinal passages have a circular transverse cross section.

5. The cask according to claim 4, wherein the longitudinal passages each have a longitudinal length which is greater than their respective diameter.

6. The cask according to claim 5, wherein the longitudinal passages each have a length greater than at least two times their respective diameter.

7. The cask according to claim 4, wherein the array of longitudinal passages are dispersed in a full 360 degree pattern around an entirety of the perforated sleeve.

8. The cask according to claim 5, wherein the array of longitudinal passages comprises multiple concentric rings of longitudinal passages which extend circumferentially around the perforated sleeve.

9. The cask according to claim 8, wherein the longitudinal passages in each ring have progressively larger diameters moving outwardly from the central opening.

10. The cask according to claim 9, wherein the longitudinal passages of an outermost ring each have larger diameters than the longitudinal passages of an innermost ring.

11. The cask according to claim 8, wherein the longitudinal passages are arrayed in a staggered pitch pattern.

12. The cask according to claim 11, wherein the perforated sleeve includes at least three concentric rings of longitudinal passages.

13. The cask according to claim 11, wherein each longitudinal passage is separated by a solid web of material of the perforated sleeve which is smaller in radial thickness than a largest diameter of the longitudinal passages.

14. The cask according to claim 1, wherein the longitudinal passages are closely packed such that a radial reference line drawn outwards from a geometric center of the perforated sleeve through any portion of the perforated sleeve intersects at least one longitudinal passage.

15. The cask according to claim 1, wherein the body of the perforated sleeve has a solid monolithic unitary structure which defines the central opening and longitudinal passages.

16. The cask according to claim 15, wherein the body of the perforated sleeve is formed of metal.

17. The cask according to claim 16, wherein the body of the perforated sleeve is formed of a soft isotopic metallic material comprising aluminum or aluminum alloy.

18. The cask according to claim 16, wherein the body of the perforated sleeve is collectively formed by multiple metallic ring segments stacked together, each ring segment defining a portion of the central opening and longitudinal passages which are concentrically aligned in each ring segment.

19. The cask according to claim 1, wherein the impact limiter further comprises an outer cap shell including a circular end wall and a sidewall extending longitudinally from the end wall, the perforated sleeve being nested inside the cap shell.

20. The cask according to claim 19, wherein the impact limiter includes a centrally-located internal annular collar which defines a receptacle which slideably receives a top end forging on the top end of the cask.

21. The cask according to claim 20, wherein the collar is spaced radially inwards from the sidewall of the end cap to define an annulus, the perforated sleeve being nested in the annulus.

22. The cask according to claim 19, wherein the outer cap shell defines an end cavity of the impact limiter, the end cavity containing an energy absorbing material.

23. The cask according to claim 22, wherein the energy absorbing material is a corrugated aluminum panel honeycomb structure or a polymeric foam material.

24. The cask according to claim 1, wherein the perforated sleeve defines a longitudinally-extending annular load transfer surface arranged to transmit an external impact force on the impact limiter to a corresponding annular impact load bearing surface formed by a diametrically reduced stepped portion of the top end of the cask.

25. The cask according to claim 1, wherein the impact limiter protrudes radially outward beyond the sidewall of the cask.

26. The cask according to claim 1, further comprising a second impact limiter coupled to the bottom end of the cask body, the second impact limiter comprising an annular perforated sleeve having a body including a central opening and a circumferential array of elongated longitudinal passages formed therethrough.

27. The cask according to claim 1, wherein the perforated sleeve has a solidity ratio less than 0.5 resulting in an open area of the sleeve collectively formed by the longitudinal passages being greater than 50 percent.

28. The cask according to claim 1, wherein the longitudinal passages are arranged in a triangular staggered 60 degree hole pattern.

29. The cask according to claim 1, wherein the perforated sleeve comprises an outer circumferential wall and an inner circumferential wall extending longitudinally between opposing major end surfaces of the perforated sleeve.

30. The cask according to claim 1, wherein the top end of the cask comprises an end forging defining an outward facing annular bearing surface which is radially aligned with an inwardly facing annular load transfer surface of the perforated sleeve.

* * * * *